US009972255B2

(12) United States Patent
Kabe et al.

(10) Patent No.: US 9,972,255 B2
(45) **Date of Patent: *May 15, 2018**

(54) DISPLAY DEVICE, METHOD FOR DRIVING THE SAME, AND ELECTRONIC APPARATUS

(71) Applicant: Japan Display Inc., Tokyo (JP)

(72) Inventors: Masaaki Kabe, Tokyo (JP); Toshiyuki Nagatsuma, Tokyo (JP); Amane Higashi, Tokyo (JP); Yoko Fukunaga, Tokyo (JP)

(73) Assignee: Japan Display Inc., Tokyo (JP)

( * ) Notice: Subject to any disclaimer, the term of this patent is extended or adjusted under 35 U.S.C. 154(b) by 388 days.

This patent is subject to a terminal disclaimer.

(21) Appl. No.: 14/724,334

(22) Filed: May 28, 2015

(65) Prior Publication Data

US 2015/0348477 A1 Dec. 3, 2015

(30) Foreign Application Priority Data

May 30, 2014 (JP) ..... 2014-113446

(51) Int. Cl.
*G09G 3/36* (2006.01)

(52) U.S. Cl.
CPC ... *G09G 3/3607* (2013.01); *G09G 2300/0452* (2013.01); *G09G 2320/0626* (2013.01)

(58) Field of Classification Search
CPC ... G09G 2300/0452; G09G 2320/0626; G09G 3/3607
See application file for complete search history.

(56) References Cited

U.S. PATENT DOCUMENTS 8,194,094 B2 * 6/2012 Sakaigawa ..... G09G 3/2003 345/204
8,830,277 B2 9/2014 Higashi et al.
9,024,982 B2 5/2015 Higashi et al.
(Continued)

FOREIGN PATENT DOCUMENTS

CN 101615385 A 12/2009
JP 2012-022217 A 2/2012
(Continued)

OTHER PUBLICATIONS

Chinese Office Action dated May 24, 2017 for corresponding Chinese Patent Application No. 20510272668.6.
(Continued)

*Primary Examiner* — Afroza Chowdhury
(74) *Attorney, Agent, or Firm* — Michael Best & Friedrich LLP

(57) ABSTRACT

According to an aspect, a display device includes: an image display panel in which pixels are arranged in a two-dimensional matrix, each of the pixels including a first sub-pixel displaying a first color, a second sub-pixel displaying a second color, a third sub-pixel displaying a third color, and a fourth sub-pixel displaying a fourth color; and a signal processing unit that converts input values of input signals into extended values in an extended color space to generate output signals, and outputs the generated output signals to the image display panel. The signal processing unit changes the output signals for the first to fourth sub-pixels based on at least saturation of the input signals.

10 Claims, 18 Drawing Sheets

(56) References Cited

U.S. PATENT DOCUMENTS

| | | | | |
|---|---|---|---|---|
| 9,324,283 | B2 * | 4/2016 | Kabe | G09G 3/3648 |
| 2009/0315921 | A1 | 12/2009 | Sakalgawa et al. | |
| 2012/0013649 | A1 * | 1/2012 | Higashi | G09G 3/3426 345/690 |
| 2014/0168284 | A1 * | 6/2014 | Kabe | G09G 3/3648 345/690 |

FOREIGN PATENT DOCUMENTS

| | | | |
|---|---|---|---|
| JP | 2014-006328 | A | 1/2014 |
| JP | 2014-007739 | A | 1/2014 |

OTHER PUBLICATIONS

Japanese Office Action dated Dec. 19, 2017 for corresponding Japanses Patent Application No. 2014-113446.

* cited by examiner

DISPLAY DEVICE, METHOD FOR DRIVING THE SAME, AND ELECTRONIC APPARATUS

CROSS-REFERENCE TO RELATED APPLICATIONS

This application claims priority from Japanese Application No. 2014-113446, filed on May 30, 2014, the contents of which are incorporated by reference herein in its entirety.

BACKGROUND

1. Technical Field

The present disclosure relates to a display device, a method for driving the display device, and an electronic apparatus including the display device.

2. Description of the Related Art

Display devices such as liquid crystal display devices include transmissive display devices and reflective display devices. Transmissive display devices display images with light transmitted through a liquid crystal panel by emitting the light from a backlight provided on the back side of the liquid crystal panel. Reflective display devices display images with reflected light obtained by reflecting light emitted from the front of a liquid crystal panel toward the liquid crystal panel.

A technique has been developed by which a white pixel serving as a fourth sub-pixel is added to conventional red, green, and blue sub-pixels serving as first to third sub-pixels, as disclosed in Japanese Patent Application Laid-open Publication No. 2012-22217 (JP-A-2012-22217). With this technique, the white sub-pixel increases luminance, thereby causing images to be brightly displayed and improving visibility of the display device. In particular, images on a reflective display device are darker than those on a transmissive display device in some cases, so that the white pixel is added so as to able to appropriately brighten the images.

According to the technique of JP-A-2012-22217, an expansion coefficient for expanding an input signal is varied according to brightness of the input signal. Accordingly, the expansion coefficient increases as the brightness decreases, that is, as the gradation level decreases, and the expansion coefficient decreases as the brightness increases, that is, as the gradation level increases. As a result, the luminance on the low gradation side increases, and the visibility of the display device is improved. However, according to the technique of JP-A-2012-22217, the luminance always increases at a constant rate (expansion coefficient) with respect to saturation. Hence, lowering (deterioration) in display quality, such as gradation collapse and/or a change in color, may be caused on the high saturation side.

For the foregoing reasons, there is a need for a display device, a method for driving the same, and an electronic apparatus that can reduce deterioration of images.

SUMMARY

According to an aspect, a display device includes: an image display panel in which pixels are arranged in a two-dimensional matrix, each of the pixels including a first sub-pixel that displays a first color, a second sub-pixel that displays a second color, a third sub-pixel that displays a third color, and a fourth sub-pixel that displays a fourth color; and a signal processing unit that converts input values of input signals into extended values in a color space extended with the first color, the second color, the third color, and the fourth color to generate output signals, and outputs the generated output signals to the image display panel. Each of the first sub-pixel, the second sub-pixel, the third sub-pixel, and the fourth sub-pixel includes a pixel electrode that is supplied with a video signal and reflects light incident thereon from a front surface of the image display panel. The signal processing unit obtains an output signal for the first sub-pixel based on at least an input signal of the first sub-pixel and an expansion coefficient and outputs the obtained output signal to the first sub-pixel, obtains an output signal for the second sub-pixel based on at least an input signal of the second sub-pixel and the expansion coefficient and outputs the obtained output signal to the second sub-pixel, obtains an output signal for the third sub-pixel based on at least an input signal of the third sub-pixel and the expansion coefficient and outputs the obtained output signal to the third sub-pixel, and obtains an output signal for the fourth sub-pixel based on the input signal of the first sub-pixel, the input signal of the second sub-pixel, the input signal of the third sub-pixel, and the expansion coefficient and outputs the obtained output signal to the fourth sub-pixel. The signal processing unit changes the output signal for the first sub-pixel, the output signal for the second sub-pixel, the output signal for the third sub-pixel, and the output signal for the fourth sub-pixel based on at least saturation of the input signals.

According to another aspect, a method for driving a display device including an image display panel in which pixels are arranged in a two-dimensional matrix, each of the pixels including a first sub-pixel that displays a first color, a second sub-pixel that displays a second color, a third sub-pixel that displays a third color, and a fourth sub-pixel that displays a fourth color, a light source unit that irradiates the image display panel with light, and a signal processing unit that converts input values of input signals into extended values in a color space extended with the first color, the second color, the third color, and the fourth color to generate output signals, and outputs the generated output signals to the image display panel, each of the first sub-pixel, the second sub-pixel, the third sub-pixel, and the fourth sub-pixel including a pixel electrode that is supplied with a video signal and reflects light from the light source unit includes: obtaining an output signal for each of the first sub-pixel, the second sub-pixel, the third sub-pixel, and the fourth sub-pixel; and controlling an operation of each of the first sub-pixel, the second sub-pixel, the third sub-pixel, and the fourth sub-pixel, based on each output signal. The obtaining of the output signal includes: obtaining the output signal for the first sub-pixel based on at least an input signal of the first sub-pixel and an expansion coefficient; obtaining the output signal for the second sub-pixel based on at least an input signal of the second sub-pixel and the expansion coefficient; obtaining the output signal for the third sub-pixel based on at least an input signal of the third sub-pixel and the expansion coefficient; obtaining the output signal for the fourth sub-pixel based on the input signal of the first sub-pixel, the input signal of the second sub-pixel, the input signal of the third sub-pixel, and the expansion coefficient; and determining the output signal for the first sub-pixel, the output signal for the second sub-pixel, the output signal for the third sub-pixel, and the output signal for the fourth sub-pixel that change based on at least saturation of the input signals.

DETAILED DESCRIPTION

Figure 1:
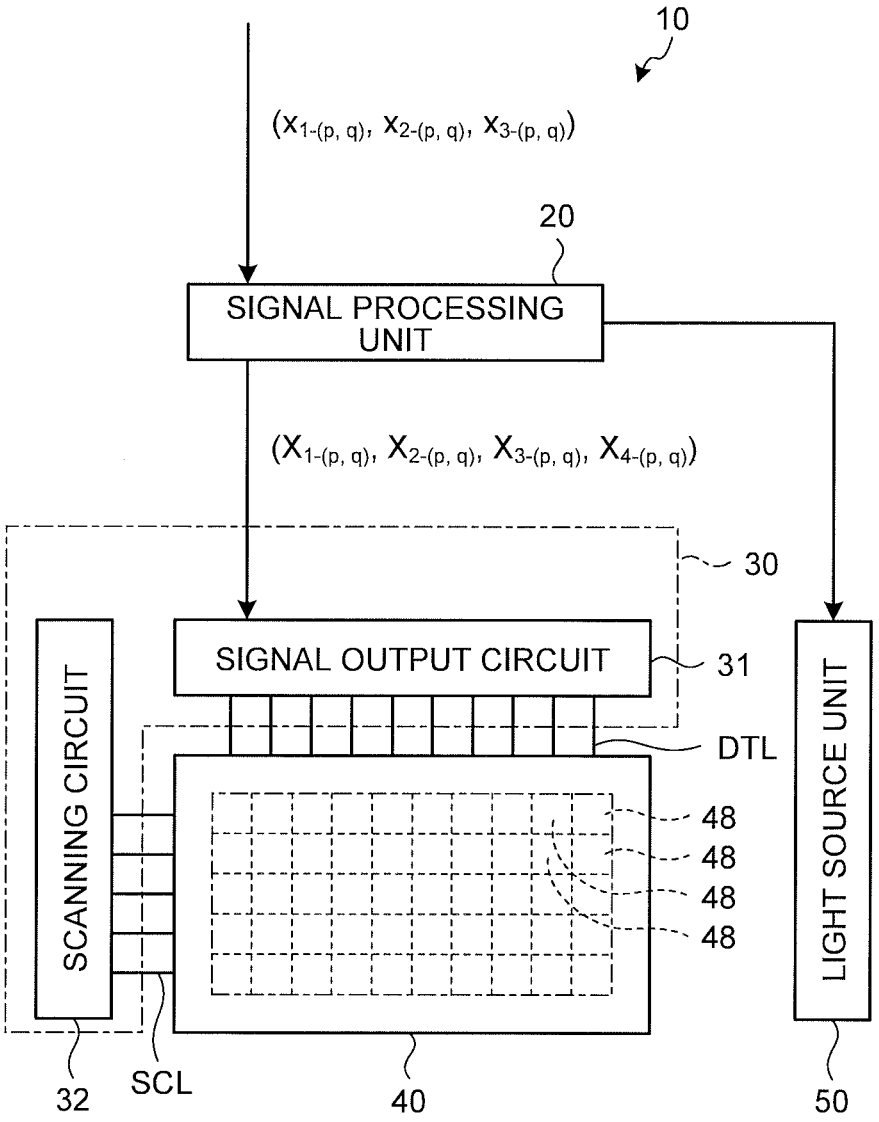
FIG. 1 is a block diagram illustrating an example of the configuration of a display device according to a first embodiment.

The following describes embodiments of the present disclosure in detail in the following order with reference to the drawings.

1. First Embodiment
2. Modification 1
3. Modification 2
4. Second Embodiment
5. Application Examples

1. First Embodiment

The following describes the embodiments of the present invention with reference to the drawings. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will be omitted as appropriate in some cases.

Configuration of Display Device

Figure 2:
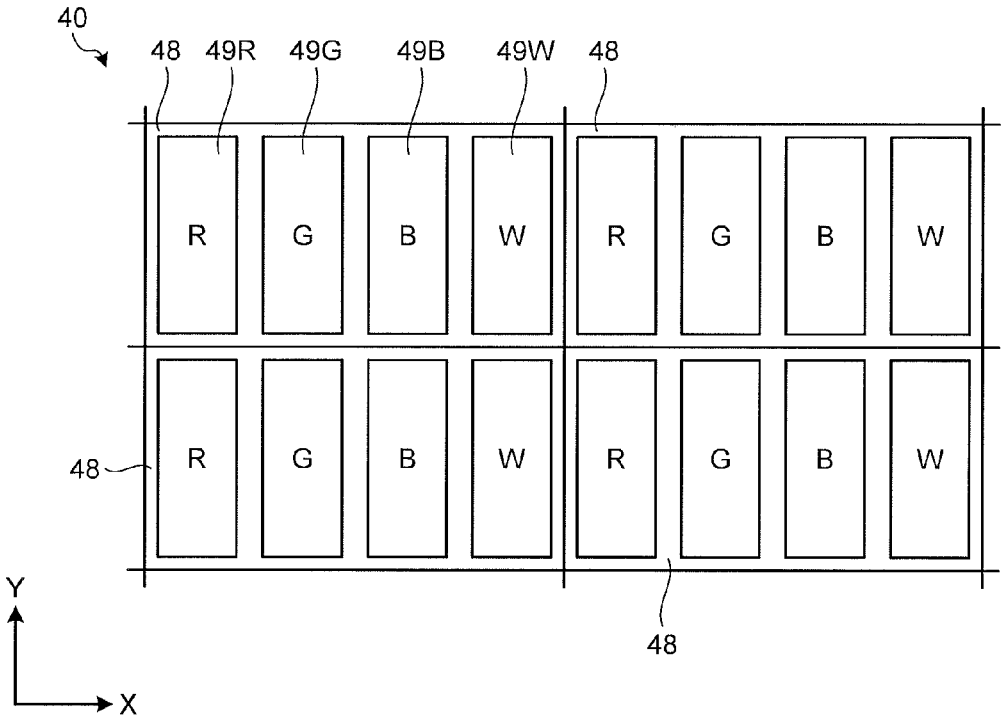
FIG. 2 is a diagram illustrating an example of a pixel array of an image display panel according to the first embodiment.
Figure 3:
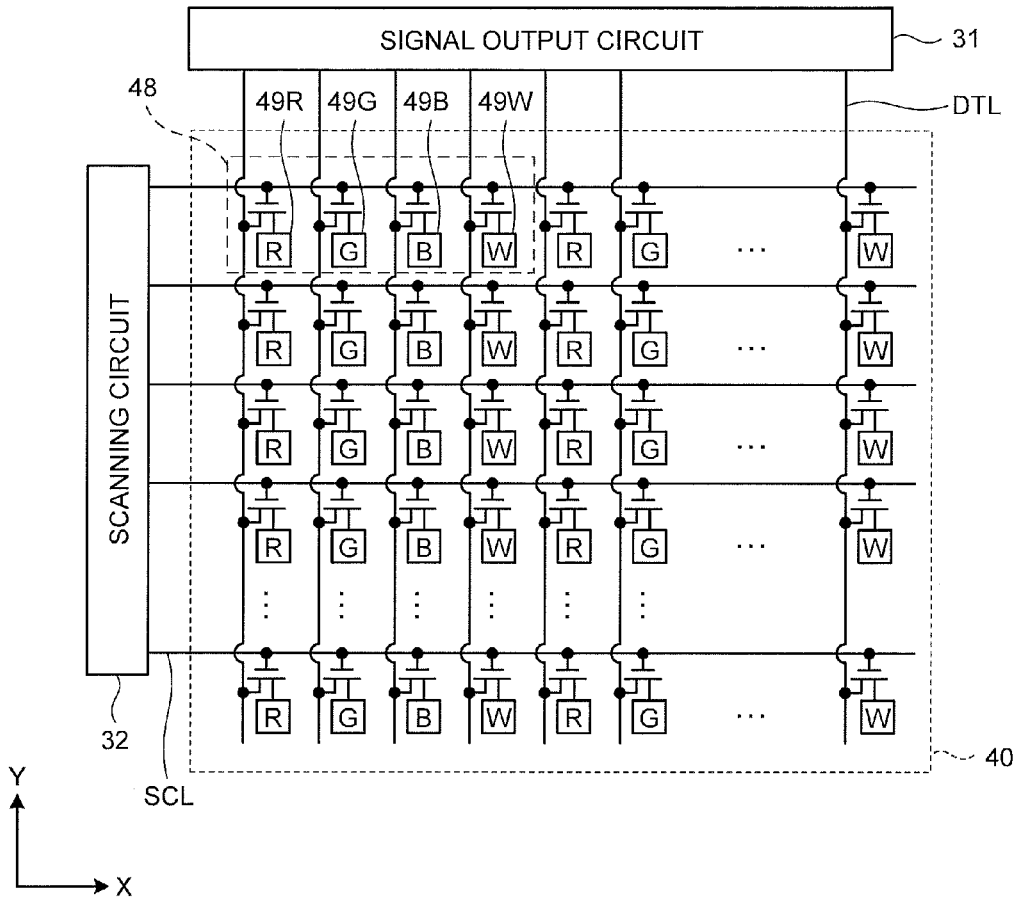
FIG. 3 is a conceptual diagram of the image display panel and an image display panel driving unit of the display device according to the first embodiment.

FIG. 1 is a block diagram illustrating an example of the configuration of a display device according to a first embodiment. FIG. 2 is a diagram illustrating an example of a pixel array of an image display panel according to the first embodiment. FIG. 3 is a conceptual diagram of the image display panel and an image display panel driving unit according to the first embodiment. As illustrated in FIG. 1, a display device 10 of the first embodiment includes a signal processing unit 20, an image-display-panel driving unit 30, an image display panel 40, and a light source unit 50. In the display device 10, the signal processing unit 20 sends signals to components of the display device 10; the image-display-panel driving unit 30 controls driving of the image display panel 40 based on signals received from the signal processing unit 20; and the image display panel 40 causes an image to be displayed based on the signals received from the image-display-panel driving unit 30. The display device 10 displays the image by reflecting external light on the image display panel 40. In cases such as when being used at night in an outdoor place with insufficient external light or used in a dark place, the display device 10 can display the image by reflecting light emitted from the light source unit 50 on the image display panel 40.

As illustrated in FIGS. 2 and 3, in the image display panel 40, pixels 48 are arranged in a two-dimensional matrix of $P_0 \times Q_0$ pixels ($P_0$ in the row direction, and $Q_0$ in the column direction). FIGS. 2 and 3 illustrate an example in which the pixels 48 are arranged in a matrix in a two-dimensional XY coordinate system. In this example, the row direction as a first direction corresponds to the X-axis direction, and the column direction as a second direction corresponds to the Y-axis direction. The row direction may correspond to the Y-axis direction, and the column direction may correspond to the X-axis direction.

Each of the pixels 48 includes a first sub-pixel 49R, a second sub-pixel 49G, and either a third sub-pixel 49B or a fourth sub-pixel 49W. The first sub-pixel 49R displays a first primary color (for example, red). The second sub-pixel 49G displays a second primary color (for example, green). The third sub-pixel 49B displays a third primary color (for example, blue). The fourth sub-pixel 49W displays a fourth color (white in the first embodiment). In this way, each of the pixels 48 arranged in a matrix in the image display panel 40 includes the first sub-pixel 49R that displays a first color, the second sub-pixel 49G that displays a second color, the third sub-pixel 49B that displays a third color, and the fourth sub-pixel 49W that displays the fourth color. The first color, the second color, the third color, and the fourth color are not limited to the first primary color, the second primary color, the third primary color, and white, but only need to be different colors from one another, such as complementary colors. The fourth sub-pixel 49W that displays the fourth color is preferably brighter than the first sub-pixel 49R that displays the first color, the second sub-pixel 49G that displays the second color, and the third sub-pixel 49B that displays the third color when irradiated with the same lighting quantity of a light source. In the following description, the first sub-pixel 49R, the second sub-pixel 49G, the third sub-pixel 49B, and the fourth sub-pixel 49W will be called a sub-pixel 49 when they need not be distinguished from one another.

The display device 10 is more specifically a reflective color liquid crystal display device. The image display panel 40 is a color liquid crystal display panel. The first sub-pixel 49R is provided with a first color filter, through which light is transmitted toward an image observer to be displayed as the first primary color. The second sub-pixel 49G is provided with a second color filter, through which light is transmitted toward the image observer to be displayed as the second primary color. The third sub-pixel 49B is provided with a third color filter, through which light is transmitted toward the image observer to be displayed as the third primary color. The image display panel 40 has no color filter between the fourth sub-pixel 49W and the image observer. A transparent resin layer may be provided for the fourth sub-pixel 49W instead of the color filter. The image display panel 40 thus provided with the transparent resin layer can suppress the occurrence of a large gap above the fourth sub-pixel 49W, otherwise a large gap occurs because no color filter is arranged for the fourth sub-pixel 49W.

Figure 4:
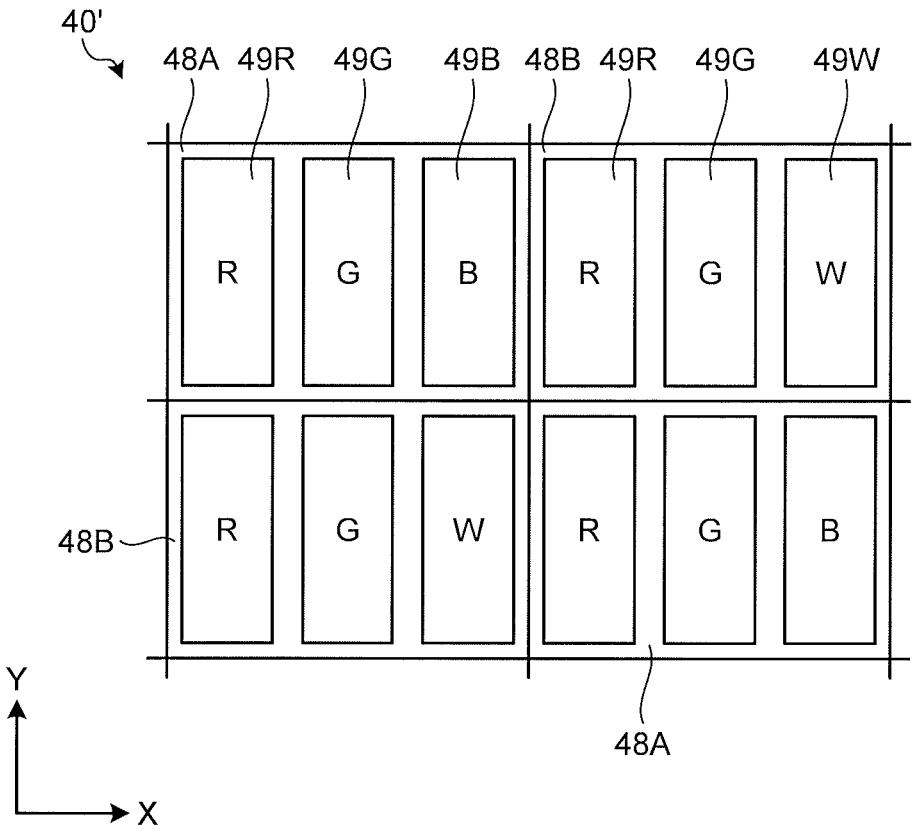
FIG. 4 is a diagram illustrating another example of a pixel array of the image display panel according to the first embodiment.

In the example illustrated in FIG. 2, the first, the second, the third, and the fourth sub-pixels 49R, 49G, 49B, and 49W in the image display panel 40 are arranged in an array similar to a stripe array. The structure and arrangement of the sub-pixels 49R, 49G, 49B, and 49W included in each of the pixels 48 are not limited. For example, the first, the second, the third, and the fourth sub-pixels 49R, 49G, 49B, and 49W in the image display panel 40 may be arranged in an array similar to a diagonal array (mosaic array). The sub-pixels may also be arranged, for example, in an array similar to a delta array (triangular array), or a rectangular array. FIG. 4 is a diagram illustrating another example of the pixel array of the image display panel according to the first embodiment. As illustrated in an image display panel 40' in FIG. 4, pixels 48A each including the first, the second, and the third sub-pixels 49R, 49G, and 49B and pixels 48B each including the first and the second sub-pixels 49R and 49G and the fourth sub-pixel 49W may be alternately arranged in the row direction and the column direction.

In general, an array similar to a stripe array is preferred to display data or character strings on a personal computer or the like. In contrast, an array similar to a mosaic array is preferred to display a natural image on a video camera recorder, a digital still camera, or the like.

As illustrated in FIG. 1, the signal processing unit 20 is an arithmetic processing circuit that controls operations of the image display panel 40 via the image-display-panel driving unit 30. The signal processing unit 20 is coupled to the image-display-panel driving unit 30 and the light source unit 50.

The signal processing unit 20 processes input signals received from an external application processor (a host CPU, not illustrated) to generate output signals. The signal processing unit 20 converts input values of the input signals into extended values (output signals) in an extended color space (an extended HSV color space in the first embodiment) to be extended with the first color, the second color, the third color, and the fourth color. The signal processing unit 20 then outputs the generated output signals to the image-display-panel driving unit 30. In the first embodiment, the extended color space is an HSV (Hue-Saturation-Value, Value is also called Brightness) color space, but not limited to this, and may be an XYZ color space, a YUV space, or any other coordinate system.

As illustrated in FIGS. 1 and 2, the image-display-panel driving unit 30 includes a signal output circuit 31 and a scanning circuit 32. In the image-display-panel driving unit 30, the signal output circuit 31 holds video signals and sequentially outputs them to the image display panel 40. More specifically, the signal output circuit 31 outputs image output signals having certain electric potentials corresponding to the output signals from the signal processing unit 20 to the image display panel 40. The signal output circuit 31 is electrically coupled to the image display panel 40 through signal lines DTL. The scanning circuit 32 controls on/off of each switching element (for example, TFT) for controlling an operation (optical transmittance) of the sub-pixel 49 in the image display panel 40. The scanning circuit 32 is electrically coupled to the image display panel 40 through wiring SCL.

Figure 5:
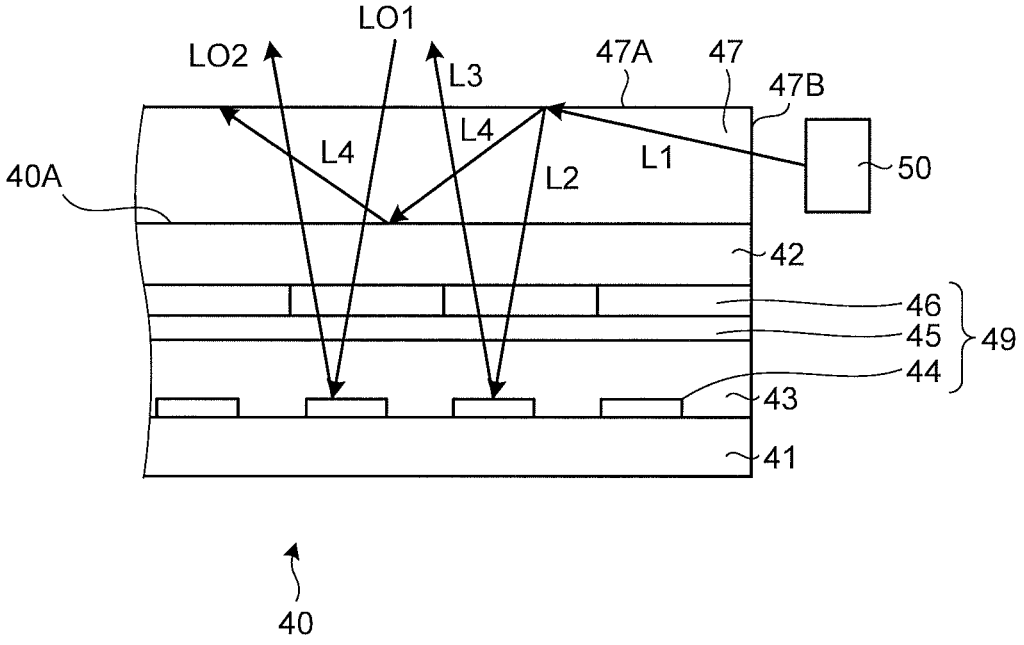
FIG. 5 is a sectional view schematically illustrating a structure of the image display panel according to the first embodiment.

FIG. 5 is a sectional view schematically illustrating a structure of the image display panel according to the first embodiment. As illustrated in FIG. 5, the image display panel 40 includes an array substrate 41 and a counter substrate 42 facing each other, and a liquid crystal layer 43 including liquid crystal elements is provided between the array substrate 41 and the counter substrate 42.

The A plurality of pixel electrodes 44 are provided on the liquid crystal layer 43 side of the array substrate 41. The pixel electrodes 44 are coupled to the signal lines DTL via the switching elements, and receive the image output signals as the video signals applied thereto. The pixel electrodes 44 are reflective members of, for example, aluminum or silver, and reflect external light or light from the light source unit 50. In other words, the pixel electrodes 44 constitute reflectors in the first embodiment.

The counter substrate 42 is a transparent substrate, such as a glass substrate. A counter electrode 45 and color filters 46 are provided on the liquid crystal layer 43 side of the counter substrate 42. More specifically, the counter electrode 45 is provided on surfaces of the color filters 46 facing the liquid crystal layer 43.

The counter electrode 45 is made of a transparent conductive material, such as indium tin oxide (ITO) or indium zinc oxide (IZO). The counter electrode 45 is coupled to the switching elements, which are coupled to the pixel electrodes 44. Each of the pixel electrodes 44 and the counter electrode 45 are provided facing each other. Due to this, when a voltage corresponding to each of the image output signals applies between the pixel electrode 44 and the counter electrode 45, the pixel electrode 44 and the counter electrode 45 produce an electric field in the liquid crystal layer 43. The electric field produced in the liquid crystal layer twists the liquid crystal elements to change the birefringence index thereof, and thus, the display device 10 adjusts the quantity of light reflected from the image display panel 40. The image display panel 40 is what is called a vertical electric field mode panel, but may be a horizontal electric field mode panel in which the electric field is produced parallel to the display surface of the image display panel 40.

The color filters 46 are the first, the second, and the third color filters described above, and are provided so as to correspond to the pixel electrodes. Each of the pixel electrodes 44, the counter electrode 45, and corresponding one of the color filters 46 constitute the sub-pixel 49.

A light guide plate 47 is provided on a side opposite to the liquid crystal layer 43 side of the counter substrate 42. The light guide plate 47 is a transparent plate-like member of, for example, an acrylic resin, a polycarbonate (PC) resin, or a methyl methacrylate-styrene copolymer (MS resin). Prisms are formed on an upper surface 47A of the light guide plate 47 that is a surface opposite to the counter substrate 42.

The light source unit 50 is LEDs in the first embodiment. As illustrated in FIG. 5, the light source unit 50 is provided along a side surface 47B of the light guide plate 47. The light source unit 50 irradiates the image display panel 40 with light from the front surface of the image display panel 40 through the light guide plate 47. The light source unit 50 is switched on and off, for example, by operation of the image observer or by an external light sensor that is mounted on the display device 10 and measures external light. The light source unit 50 emits light when being on, and does not emit light when being off. For example, when the image observer feels an image to be dark, the image observer turns on the light source unit 50 to irradiate the image display panel 40 with light from the light source unit 50 so as to brighten the image. When the external light sensor determines that the external light intensity is lower than a predetermined value, the signal processing unit 20, for example, turns on the light source unit 50 to irradiate the image display panel 40 with light from the light source unit 50 so as to brighten the image. In the first embodiment, the signal processing unit 20 does not control the luminance of light of the light source unit 50 according to an expansion coefficient $\alpha$. In other words, the luminance of light of the light source unit 50 is set independently of the expansion coefficient $\alpha$ to be described later. The luminance of light of the light source unit 50 may, however, be adjusted according to operation of the image observer or a measurement result of the external light sensor.

The following describes reflection of light by the image display panel 40. As illustrated in FIG. 5, external light LO1 is incident on the image display panel 40. The external light LO1 is incident on each of the pixel electrodes 44 through the light guide plate 47 and the image display panel 40. The external light LO1 incident on the pixel electrode 44 is reflected by the pixel electrode 44, and exits, as light LO2, to the outside through the image display panel 40 and the light guide plate 47. Turning on the light source unit 50 causes light L1 from the light source unit 50 to be incident from the side surface 47B into the light guide plate 47. The light L1 incident into the light guide plate 47 is scattered and reflected on the upper surface 47A of the light guide plate 47. A part of the reflected light is incident, as light L2, on the image display panel 40 from the counter substrate 42 side of the image display panel 40, and is projected on the pixel electrode 44. The light L2 projected on the pixel electrode 44 is reflected by the pixel electrode 44, and exits, as light L3, to the outside through the image display panel 40 and the light guide plate 47. The other part of the light scattered on the upper surface 47A of the light guide plate 47 is reflected as light L4, and repeats being reflected in the light guide plate 47.

In other words, the pixel electrodes 44 reflect the external light LO1 and/or the light L2 toward the outside, the external light LO1 being incident on the image display panel 40 from the front surface thereof that is a surface on the external side (the counter substrate 42 side) of the image display panel 40. The light LO2 and the light L3 reflected toward the outside pass through the liquid crystal layer 43 and the color filters 46. Due to this, the display device 10 can display an image with the light LO2 and the light L3. As described above, the display device 10 according to the first embodiment is a reflective display device that is of a front light type and includes the light source unit 50 of an edge light type. Although the display device 10 includes the light source unit 50 and the light guide plate 47 in the first embodiment, the display device 10 need not include the light source unit 50 and the light guide plate 47. In this case, the display device 10 can display the image with the light LO2 obtained by reflecting the external light LO1.

Processing Operation of Display Device

Figure 6:
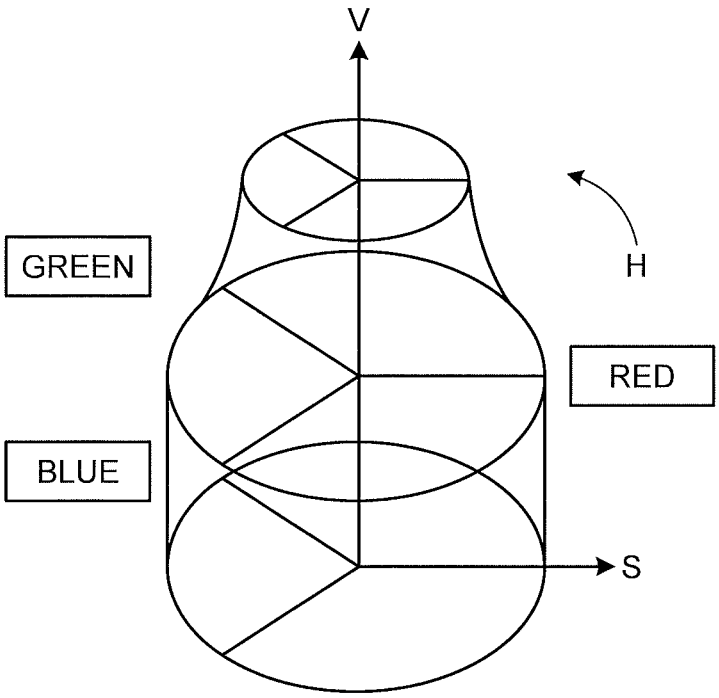
FIG. 6 is a conceptual diagram of an extended HSV color space that can be extended by the display device according to the first embodiment.
Figure 7:
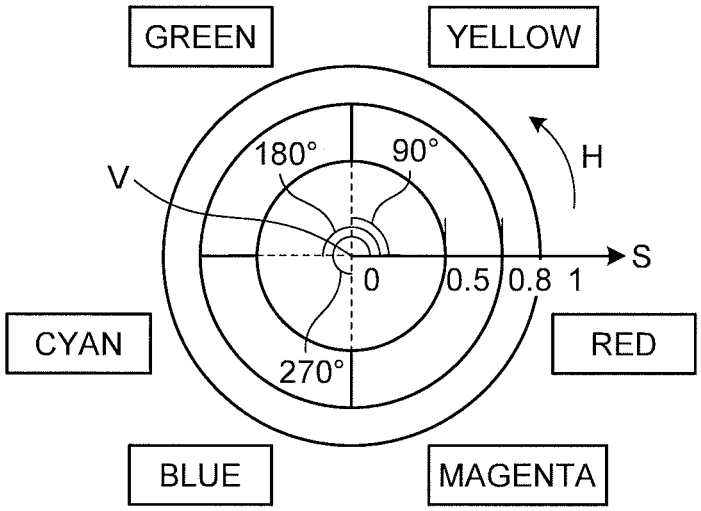
FIG. 7 is a conceptual diagram illustrating a relation between a hue and saturation in the extended HSV color space.

FIG. 6 is a conceptual diagram of the extended HSV color space that can be extended by the display device according to the first embodiment. FIG. 7 is a conceptual diagram illustrating a relation between a hue and saturation in the extended HSV color space. The signal processing unit 20 receives from the outside the input signals that are information of the image to be displayed. The input signals include information (color) as an input signal for each pixel displaying the image at the position thereof. Specifically, in the image display panel 40 in which the $P_0 \times Q_0$ pixels 48 are arranged in a matrix, with respect to the (p,q)-th pixel 48 (where $1 \le p \le P_0$ and $1 \le q \le Q_0$), the signal processing unit 20 receives the signals including the input signal of the first sub-pixel 49R having a signal value of $x_{1-(p,q)}$, the input signal of the second sub-pixel 49G having a signal value of $x_{2-(p,q)}$, and the input signal of the third sub-pixel 49B having a signal value of $x_{3-(p,q)}$ (refer to FIG. 1).

The signal processing unit 20 illustrated in FIG. 1 processes the input signals to generate an output signal (signal value $X_{1-(p,q)}$) for the first sub-pixel for determining the display gradation of the first sub-pixel 49R, an output signal (signal value $X_{2-(p,q)}$) for the second sub-pixel for determining the display gradation of the second sub-pixel 49G, an output signal (signal value $X_{3-(p,q)}$) for the third sub-pixel for determining the display gradation of the third sub-pixel 49B, and an output signal (signal value $X_{4-(p,q)}$) for the fourth sub-pixel for determining the display gradation of the fourth sub-pixel 49W, and outputs the generated output signals to the image-display-panel driving unit 30.

In the display device 10, the pixel 48 includes the fourth sub-pixel 49W for outputting the fourth color (white) so as to be capable of widening a dynamic range of brightness in the HSV color space (extended HSV color space) as illustrated in FIG. 6. Specifically, as illustrated in FIG. 6, a substantially truncated cone is placed on a cylindrical color space that can be displayed by the first sub-pixel, the second sub-pixel, and the third sub-pixel. The substantially truncated cone has a cross section that includes a saturation axis and a brightness axis and has curved oblique sides along which the maximum value of brightness decreases as the saturation increases. The input signals include the input signals of the first sub-pixel 49R, the second sub-pixel 49G, and the third sub-pixel 49B, so that the HSV color space of the input signals has a cylindrical shape, that is, the same shape as a cylindrical part of the extended HSV color space.

Then, based on at least the input signal (signal value $x_{1-(p,q)}$ of the first sub-pixel 49R and the expansion coefficient $\alpha$, the signal processing unit 20 calculates the output signal (signal value $X_{1-(p,q)}$ for the first sub-pixel 49R, and outputs the result to the first sub-pixel 49R. Based on at least the input signal (signal value $x_{2-(p,q)}$) of the second sub-pixel 49G and the expansion coefficient $\alpha$, the signal processing unit 20 calculates the output signal (signal value $X_{2-(p,q)}$) for the second sub-pixel 49G, and outputs the result to the second sub-pixel 49G. Based on at least the input signal (signal value $x_{3-(p,q)}$) of the third sub-pixel 49B and the expansion coefficient $\alpha$, the signal processing unit 20 calculates the output signal (signal value $X_{3-(p,q)}$) for the third sub-pixel 49B, and outputs the result to the third sub-pixel 49B. In addition, based on the input signal (signal value $x_{1-(p,q)}$) of the first sub-pixel 49R, the input signal (signal value $x_{2-(p,q)}$) of the second sub-pixel 49G, and the input signal (signal value $x_{3-(p,q)}$) of the third sub-pixel 49B, the signal processing unit 20 calculates the output signal (signal value $X_{4-(p,q)}$) for the fourth sub-pixel 49W, and outputs the result to the fourth sub-pixel 49W. The expansion coefficient $\alpha$ is a coefficient for expanding the input signals, and will be described later in detail.

Specifically, the signal processing unit 20 calculates the output signal for the first sub-pixel based on the input signal of the first sub-pixel, the expansion coefficient $\alpha$, and the output signal for the fourth sub-pixel. The signal processing unit 20 calculates the output signal for the second sub-pixel based on the input signal of the second sub-pixel, the expansion coefficient $\alpha$, and the output signal for the fourth sub-pixel. The signal processing unit 20 calculates the output signal for the third sub-pixel based on the input signal of the third sub-pixel, the expansion coefficient $\alpha$, and the output signal for the fourth sub-pixel.

That is, when $\chi$ is defined as a constant depending on the display device, the signal processing unit 20 obtains, from the following expressions (1) to (3), the signal value $X_{1-(p,q)}$ serving as the output signal value for the first sub-pixel 49R, the signal value $X_{2-(p,q)}$ serving as the output signal value for the second sub-pixel 49G, and the signal value $X_{3-(p,q)}$ serving as the output signal value for the third sub-pixel 49B, the signal values being output to the (p,q)-th pixel (or a group of the first sub-pixel 49R, the second sub-pixel 49G, and the third sub-pixel 49B).

$$X_{1-(p,q)}=\alpha\cdot x_{1-(p,q)}-\chi\cdot X_{4-(p,q)} \quad (1)$$

$$X_{2-(p,q)}=+\cdot x_{2-(p,q)}-\chi\cdot X_{4-(p,q)} \quad (2)$$

$$X_{3-(p,q)}=\alpha\cdot x_{3-(p,q)}-\chi\cdot X_{4-(p,q)} \quad (3)$$

The signal processing unit 20 obtains saturation S and a value (also called brightness) V(S) of the pixels 48 based on the input signal values of the sub-pixels 49 in the pixels 48.

The saturation S and the brightness V(S) are expressed as follows: S=(Max−Min)/Max, and V(S)=Max. Max is the maximum value among the input signal value of the first sub-pixel 49R, the input signal value of the second sub-pixel 49G, and the input signal value of the third sub-pixel 49B, which are supplied to the pixel 48. Min is the minimum value among the input signal value of the first sub-pixel 49R, the input signal value of the second sub-pixel 49G, and the input signal value of the third sub-pixel 49B, which are supplied to the pixel 48. A hue H is represented in the range from 0° to 360° as illustrated in FIG. 7. Red, yellow, green, cyan, blue, magenta, and red are arranged from 0° toward 360°. In the first embodiment, a region including an angular position of 0° corresponds to red, a region including an angular position of 120° corresponds to green, and a region including an angular position of 240° corresponds to blue.

In the present embodiment, the signal value $X_{4-(p,q)}$ can be obtained based on the product of the $Min_{(p,q)}$ and the expansion coefficient $\alpha$. Specifically, the signal value $X_{4-(p,q)}$ can be obtained based on the following expression (4). In the expression (4), the product of the $Min_{(p,q)}$ and the expansion coefficient $\alpha$ is divided by $\chi$. However, the calculation expression is not limited to this. $\chi$ will be described later.

$$X_{4-(p,q)}=\mathrm{Min}(p,q)\cdot\alpha/\chi \quad (4)$$

In general, in the (p,q)-th pixel, the saturation $S_{(p,q)}$ and the brightness $V(S)_{(p,q)}$ in the cylindrical HSV color space can be obtained from the following expressions (5) and (6) based on the input signal (signal value $x_{1-(p,q)}$) of the first sub-pixel 49R, the input signal (signal value $x_{2-(p,q)}$) of the second sub-pixel 49G, and the input signal (signal value of the third sub-pixel 49B.

$$S_{(p,q)}=(\mathrm{Max}_{(p,q)}-\mathrm{Min}_{(p,q)})/\mathrm{Max}_{(p,q)} \quad (5)$$

$$V(S)_{(p,q)}=\mathrm{Max}_{(p,q)} \quad (6)$$

where $Max_{(p,q)}$ is the maximum value among the input signal values ($x_{1-(p,q)}$, $x_{2-(p,q)}$, and $x_{3-(p,q)}$) of three sub-pixels 49, and $Min_{(p,q)}$ is the minimum value of the input signal values ($x_{1-(p,q)}$, $x_{2-(p,q)}$, and $x_{3-(p,q)}$) of three sub-pixels 49. In the present embodiment, n is 8. That is, the number of bits used to indicate the display gradation is 8 (the value of the display gradation is from 0 to 255 giving a total of 256 gradations).

No color filter is provided for the fourth sub-pixel 49W that displays white. Supposing that a signal having a value corresponding to the maximum signal value of the output signal for the first sub-pixel is supplied to the first sub-pixel 49R, a signal having a value corresponding to the maximum signal value of the output signal for the second sub-pixel is supplied to the second sub-pixel 49G, and a signal having a value corresponding to the maximum signal value of the output signal for the third sub-pixel is supplied to the third sub-pixel 49B, the luminance of an aggregate of the first, the second, and the third sub-pixels 49R, 49G, and 49B included in the pixel 48 or a group of pixels 48 is denoted as $BN_{1-3}$. Supposing that a signal having a value corresponding to the maximum signal value of the output signal for the fourth sub-pixel 49W is supplied to the fourth sub-pixel 49W included in the pixel 48 or a group of pixels 48, the luminance of the fourth sub-pixel 49W is denoted as $BN_4$. That is, the aggregate of the first, the second, and the third sub-pixels 49R, 49G, and 49B display white at the maximum luminance, and the luminance of the white is represented by $BN_{1-3}$. Assuming that $\chi$ is a constant depending on the display device, the constant $\chi$ is represented by $\chi=BN_4/BN_{1-3}$.

Specifically, the luminance $BN_4$ when the input signal having a value of display gradation of 255 is assumed to be supplied to the fourth sub-pixel 49W is, for example, 1.5 times the luminance $BN_{1-3}$ of white when the input signals having the following values of display gradation are supplied to the aggregate of the first, the second, and the third sub-pixels 49R, 49G, and 49B: the signal value $x_{1-(p,q)}=255$, the signal value $x_{2-(p,q)}=255$, and the signal value $x_{3-(p,q)}=255$. That is, $\chi=1.5$ in the present embodiment.

The following describes a method for obtaining the signal values $x_{1-(p,q)}$, $X_2$-(p, q), $X_{3-(p,q)}$, and $X_{4-(p,q)}$ as output signals for the (p,q)-th pixel 48 (expansion processing). The following processing is performed so as to keep a ratio among the luminance of the first primary color displayed by (first sub-pixel 49R+fourth sub-pixel 49W), the luminance of the second primary color displayed by (second sub-pixel 49G+fourth sub-pixel 49W), and the luminance of the third primary color displayed by (third sub-pixel 49B+fourth sub-pixel 49W). The processing is performed so as to also keep (maintain) color tone. The processing is performed so as to keep (maintain), furthermore, a gradation-luminance characteristic (gamma characteristic or γ characteristic).

First Process

First, the signal processing unit 20 obtains the saturation S of the pixels 48 based on the input signal values of the sub-pixels 49 in the pixels 48. Specifically, the signal processing unit 20 obtains $S_{(p,q)}$ through the expression (5) based on the signal value $x_{1-(p,q)}$ that is the input signal of the first sub-pixel 49R, the signal value $x_{2-(p,q)}$ that is the input signal of the second sub-pixel 49G, and the signal value $x_{3-(p,q)}$ that is the input signal of the third sub-pixel 49B, the signal values being supplied to the (p,q)-th pixel 48. The signal processing unit 20 applies this processing to all the pixels 48.

Second Process

Then, the signal processing unit 20 obtains the expansion coefficient α based on the saturation $S_{(p,q)}$ obtained with respect to the pixels 48. A method for obtaining the expansion coefficient α will be described later.

Third Process

Then, the signal processing unit 20 obtains the signal value $X_{4-(p,q)}$ for the (p,q)-th pixel 48 based on at least the signal value $x_{1-(p,q)}$ of the input signal, the signal value $x_{2-(p,q)}$ of the input signal, and the signal value $x_{3-(p,q)}$ of the input signal. In the present embodiment, the signal processing unit 20 determines the signal value $X_{4-(p,q)}$ based on $Min_{(p,q)}$, the expansion coefficient α, and the constant χ. More specifically, as described above, the signal processing unit 20 obtains the signal value $X_{4-(p,q)}$ based on the expression (4) given above. The signal processing unit 20 obtains the signal value $X_{4-(p,q)}$ for every one of the $P_0 \times Q_0$ pixels 48.

Fourth Process

Thereafter, the signal processing unit 20 obtains the signal value $X_{1-(p,q)}$ for the (p,q)-th pixel 48 based on the signal value $x_{1-(p,q)}$ of the input signal, the expansion coefficient α, and the signal value $X_{4-(p,q)}$, obtains the signal value $X_{2-(p,q)}$ for the (p,q)-th pixel 48 based on the signal value $x_{2-(p,q)}$ of the input signal, the expansion coefficient α, and the signal value $X_{4-(p,q)}$, and obtains the signal value $X_{3-(p,q)}$ for the (p,q)-th pixel 48 based on the signal value $x_{3-(p,q)}$ of the input signal, the expansion coefficient α, and the signal value $X_{4-(p,q)}$. Specifically, the signal processing unit 20 obtains the signal value $X_{1-(p,q)}$, the signal value $X_{2-(p,q)}$, and the signal value $X_{3-(p,q)}$ for the (p,q)-th pixel 48 based on the expressions (1) to (3) given above.

The signal processing unit 20 expands the value of $Min_{(p,q)}$ with a as represented by the expression (4). In this way, the expansion of the value of $Min_{(p,q)}$ with a increases the luminance of the white display sub-pixel (fourth sub-pixel 49W), and also increases the luminance of the red display sub-pixel, the green display sub-pixel, and the blue display sub-pixel (corresponding to the first, the second, and the third sub-pixels 49R, 49G, and 49B, respectively) as represented by the expressions given above. This increase in the luminance can avoid problems, such as dullness of color. In the first embodiment, the luminance of the light source unit 50 is constant, independently of the expansion coefficient α. That is, expanding the value of $Min_{(p,q)}$ with α increases the luminance of the entire image to α times that obtained in the case in which the value of $Min_{(p,q)}$ is not expanded. As a result, for example, a still image and the like can preferably be displayed with high luminance.

Case of Constant Expansion Coefficient α with Respect to Saturation S

Figure 8:
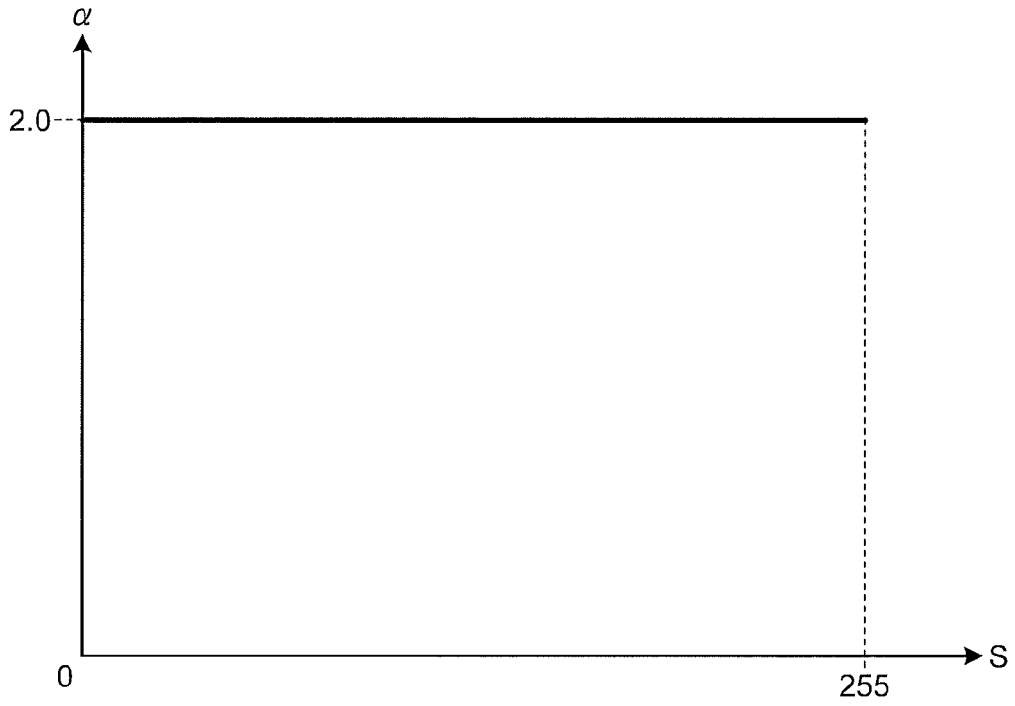
FIG. 8 is a diagram illustrating an example in which an expansion coefficient is always constant and does not change with change in the saturation.
Figure 9:
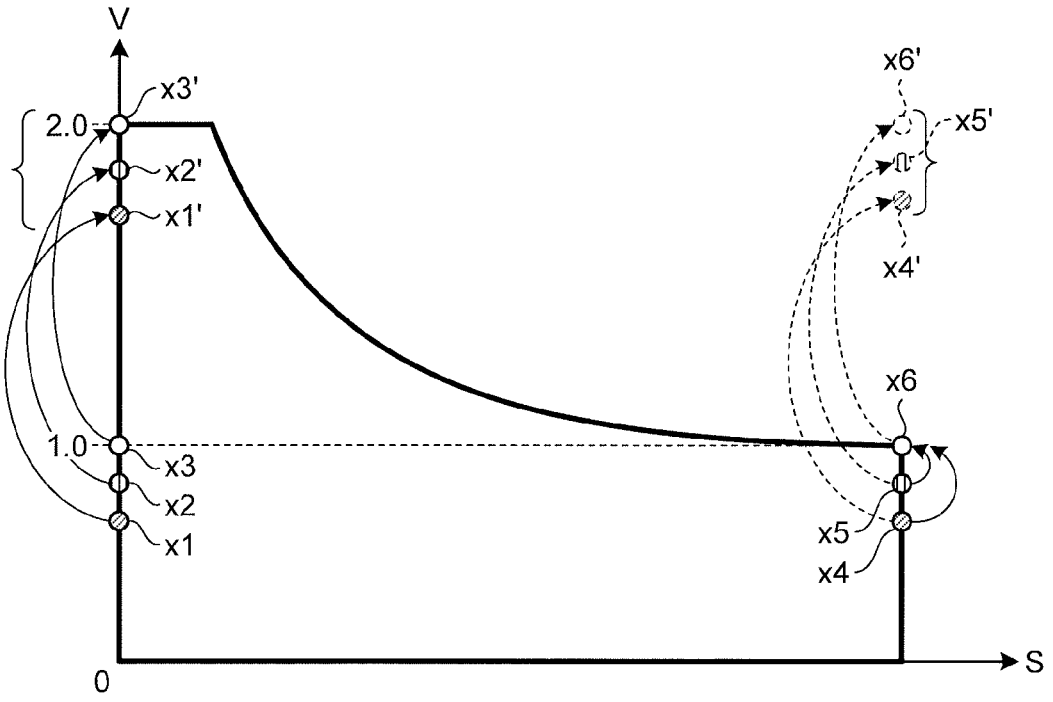
FIG. 9 is a diagram illustrating an HSV color space.
Figure 10:
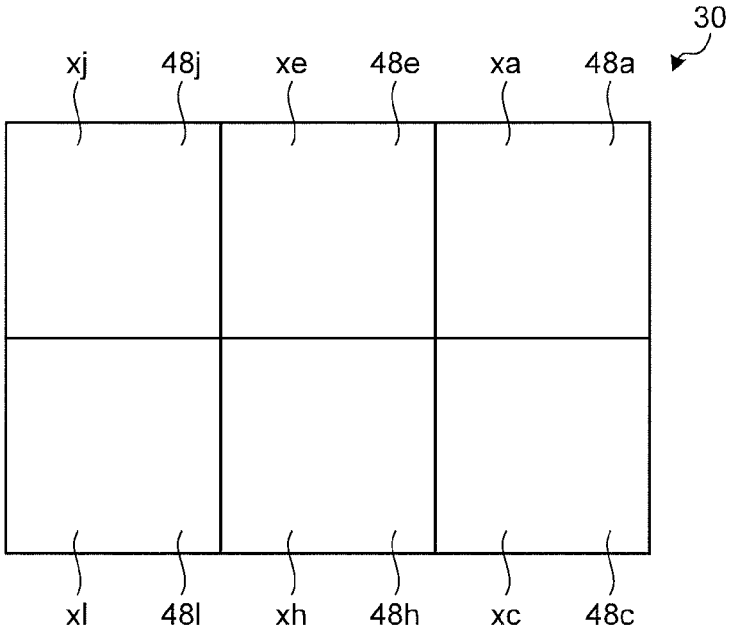
FIG. 10 is a diagram for explaining input values to respective pixels.
Figure 11:
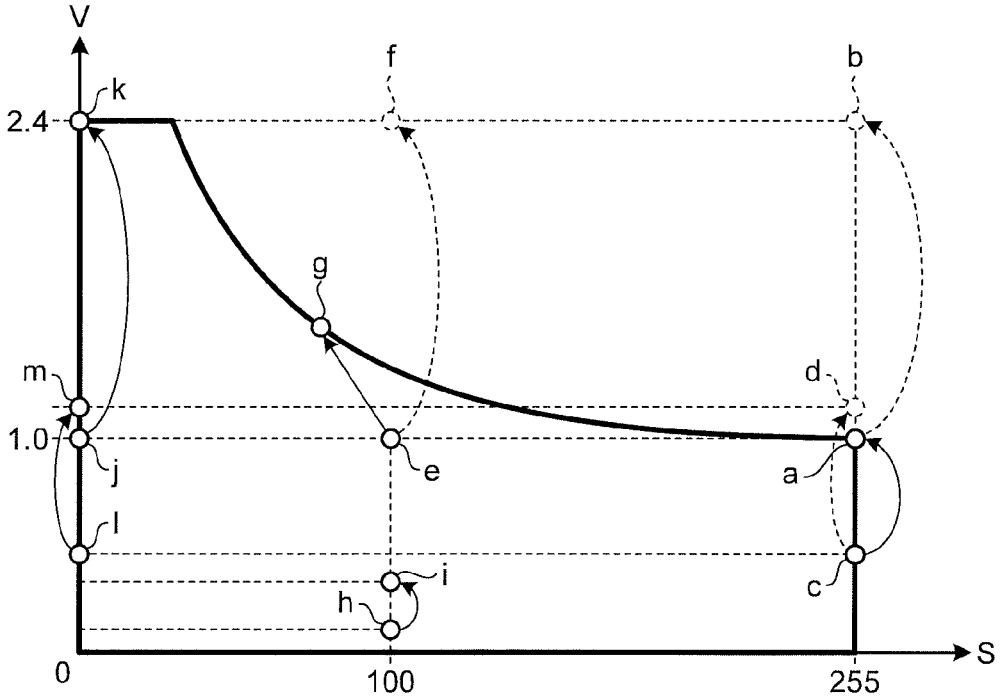
FIG. 11 is a diagram illustrating, in the HSV color space, the input signal values before and after being expanded by the expansion coefficient.

The following describes calculation of the expansion coefficient α in the first embodiment. First, as a comparative example, a case will be described in which the constant expansion coefficient α is always constant with respect to the saturation S. FIG. 8 is a diagram illustrating the example in which the expansion coefficient is always constant and does not change with change in the saturation. FIG. 9 is a diagram illustrating the HSV color space. FIG. 10 is a diagram for explaining input values to respective pixels. FIG. 11 is a diagram illustrating, in the HSV color space, the input signal values before and after being expanded by the expansion coefficient.

The case will be studied below in which the constant expansion coefficient α is always constant with respect to the saturation S as illustrated in FIG. 8. In this study, in the case in which the fourth sub-pixel 49W is added as a white display sub-pixel, an HSV color space such as that illustrated in FIG. 9 is considered, and a case is considered in which the expansion coefficient is 2.0 for the signal values giving V of 0.8 or larger. The HSV color space is normally a three-dimensional color space as illustrated in FIG. 6 given above because of including the hue H. However, description will be made using a two-dimensional color space represented by an orthogonal coordinate system of the saturation S and the brightness V, as illustrated in FIG. 9, because this study does not take the hue H into consideration.

In this study, when the signal values (gradation values) x that are values of the input signals are expressed as (Rin, Gin,Bin), the saturation S is represented by the following expression (7) and the brightness V is represented by the following expression (8). As described above, min(Rin,Gin, Bin) represents the minimum value of the signal values x(Rin,Gin,Bin), that is, Min mentioned above; and max(Rin, Gin,Bin) represents the maximum value of the signal values x(Rin,Gin,Bin), that is, Max mentioned above.

$$S=255\cdot(1-\min(Rin,Gin,Bin)/\max(Rin,Gin,Bin)) \quad (7)$$

$$V=(\max(Rin,Gin,Bin)/255)^{2.2} \quad (8)$$

In this way, the saturation S is a function of max and min of the signal values x. The brightness V is not the maximum value of the signal values (gradation values) of the input, but a value converted into luminance information obtained by normalizing and linearizing the maximum value. The saturation S and the brightness V are not limited to these values.

As illustrated in FIG. 8, the expansion coefficient α is 2 regardless of the level of the saturation S. Hence, for example, as illustrated in FIG. 9, when the saturation S is 0, a signal value x1 giving the brightness V of 0.8, a signal value x2 giving the brightness V of 0.9, and a signal value x3 giving the brightness V of 1.0 are expanded to x1', x2', and x3' that are values after the expansion giving the brightness V of 1.6, the brightness V of 1.8, and the brightness V of 2.0, respectively. In this case, as illustrated in FIG. 9, all the values x1', x2', and x3' after the expansion reside in the color space, thereby causing no problem and increasing the luminance.

When the signals give the saturation S of 255, a signal value x4 giving the brightness V of 0.8, a signal value x5 giving the brightness V of 0.9, and a signal value x6 giving the brightness V of 1.0 are supposed to be expanded to x4', x5', and x6' that are values after the expansion giving the brightness V of 1.6, the brightness V of 1.8, and the brightness V of 2.0, respectively. However, the maximum value of the brightness V of the color space is 1 when the saturation S is 255, so that all the values x4', x5', and x6' after the expansion are clipped to the brightness V of 1.0 as illustrated in FIG. 9. This means that the gradation information of the input signals giving the brightness V of 1.6, the brightness V of 1.8, and the brightness V of 2.0 is totally lost, and thus, gradation collapse occurs. As described above, when the expansion coefficient α is constant regardless of the saturation S, the luminance is significantly increased, but marked deterioration in display quality is highly likely to occur on the high-saturation side where the color space is smaller. A more specific description will be made below.

FIG. 10 illustrates that signal values xa, xc, xe, xh, xj, and xl are supplied to a plurality of pixels 48*a*, 48*c*, 48*e*, 48*h*, 48*j*, and 48*l*, respectively, included in the image display panel 40. An example will be described in which the signal values xa, xc, xe, xh, xj, and xl are supplied to the pixels 48*a*, 48*c*, 48*e*, 48*h*, 48*j*, and 48*l*, respectively, when the expansion coefficient α is 2.4 regardless of the change in the saturation S. The value of γ of the image display panel 40 is 2.2, and the number of gradations thereof is an 8-bit value, that is, 256.

When the expression (8) is used to linearize the signal value xa(R,G,B)=(255,255,0) that is the value of an input signal giving the saturation S of 255, the signal value xa is converted into $((255/255)^{2.2}, (255/255)^{2.2}, (0/255)^{2.2})$=(1,1,0), and is represented in the HSV color space by point a in FIG. 11. Multiplying the signal value xa after the linearization by the expansion coefficient α of 2.4 is supposed to give a value (2.4,2.4,0) after the expansion at point b in FIG. 11. However, because the maximum value of the brightness V of the HSV color space is 1 when the saturation S is 255, the value after the expansion remains (1,1,0), not exceeding this value, that is, does not change from point a in FIG. 11.

When the expression (8) is used to linearize the signal value xc(R,G,B)=(180,180,0) that is the value of an input signal giving the saturation S of 255, the signal value xc is converted into $((180/255)^{2.2}, (180/255)^{2.2}, (0/255)^{2.2})$=(0.46,0.46,0), and is represented in the HSV color space by point c in FIG. 11. Multiplying the signal value xc after the linearization by the expansion coefficient α of 2.4 is supposed to give a value (1.1,1.1,0) after the expansion at point d in FIG. 11. However, because the maximum value of the brightness V of the HSV color space is 1 when the saturation S is 255, the value after the expansion is set to (1,1,0), not exceeding this value, that is, located at point a in FIG. 11. In this way, expanding the signal value xa(255,255,0) or the signal value xc(180, 180, 0) by a factor of the expansion coefficient α of 2.4 gives the signal value of (255,255,0), and thus causes occurrence of the gradation collapse.

When the expression (8) is used to linearize the signal value xe(R,G,B)=(255,220,155) that is the value of an input signal giving the saturation S of 100, the signal value xe is converted into (1.0,0.72,0.33), and is represented in the HSV color space by point e in FIG. 11. Multiplying the signal value xe after the linearization by the expansion coefficient α of 2.4 does not give a value after the expansion outside the HSV color space (at point f in FIG. 11), but gives a value (1.624,1.624,0.83) at point g inside the HSV color space. Specifically, the luminance ratio of R:G:B at the signal value (1.0,0.72,0.33) obtained by linearizing the signal value xe of the input differs from the luminance ratio of R:G:B of the output value obtained by the multiplication by the expansion coefficient α of 2.4. This difference causes a change in color.

When the expression (8) is used to linearize the signal value xh(R,G,B)=(102,80,62) that is the value of an input signal giving the saturation S of 100, the signal value xh is converted into (0.13,0.08,0.045), and is represented in the HSV color space by point h in FIG. 11. Multiplying the signal value xh after the linearization by the expansion coefficient α of 2.4 gives a value (0.32,0.19,0.11) after the expansion. This value remains in the HSV color space (at point i in FIG. 11), so that the luminance ratio of R:G:B of the input does not differ from the luminance ratio of R:G:B of the output value obtained by the multiplication by the expansion coefficient α of 2.4, and hence, the deterioration in display quality does not occur.

When the expression (8) is used to linearize the signal value xj(R,G,B)=(255,255,255) that is the value of an input signal giving the saturation S of 0, the signal value xj is converted into (1,1,1), and is represented in the HSV color space by point j in FIG. 11. Multiplying the signal value xj after the linearization by the expansion coefficient α of 2.4 gives a value (2.4,2.4,2.4) after the expansion. This value remains in the HSV color space (at point k in FIG. 11), so that the luminance ratio of R:G:B of the input does not differ from the luminance ratio of R:G:B of the output value obtained by the multiplication by the expansion coefficient α of 2.4, and hence, the deterioration in display quality does not occur.

When the expression (8) is used to linearize the signal value xl(R,G,B)=(180,180,180) that is the value of an input signal giving the saturation S of 0, the signal value xl is converted into (0.46,0.46,0.46), and is represented in the HSV color space by point l in FIG. 11. Multiplying the signal value xl after the linearization by the expansion coefficient α of 2.4 gives a value (1.1,1.1,1.1) after the expansion. This value remains in the HSV color space (at point m in FIG. 11), so that the luminance ratio of R:G:B of the input does not differ from the luminance ratio of R:G:B of the output value obtained by the multiplication by the expansion coefficient α of 2.4, and hence, the deterioration in display quality does not occur. That is, multiplying the signal values xj and xl giving S=0 by the expansion coefficient α (2.4 in the present example) keeps the values after the expansion always inside the HSV color space, so that the deterioration in display quality, such as the gradation collapse and/or the change in color, does not occur.

Thus, it is found that multiplying a signal value giving the saturation S by the constant expansion coefficient α causes the occurrence of the deterioration in display quality, such as the gradation collapse and/or the change in color. It can be understood from the example described above that the display quality deteriorates more as the expansion coefficient α multiplying the input signal values xa, xc, xe, xh, xj, and xl is larger.

Expansion Coefficient According to First Embodiment

Figure 12:
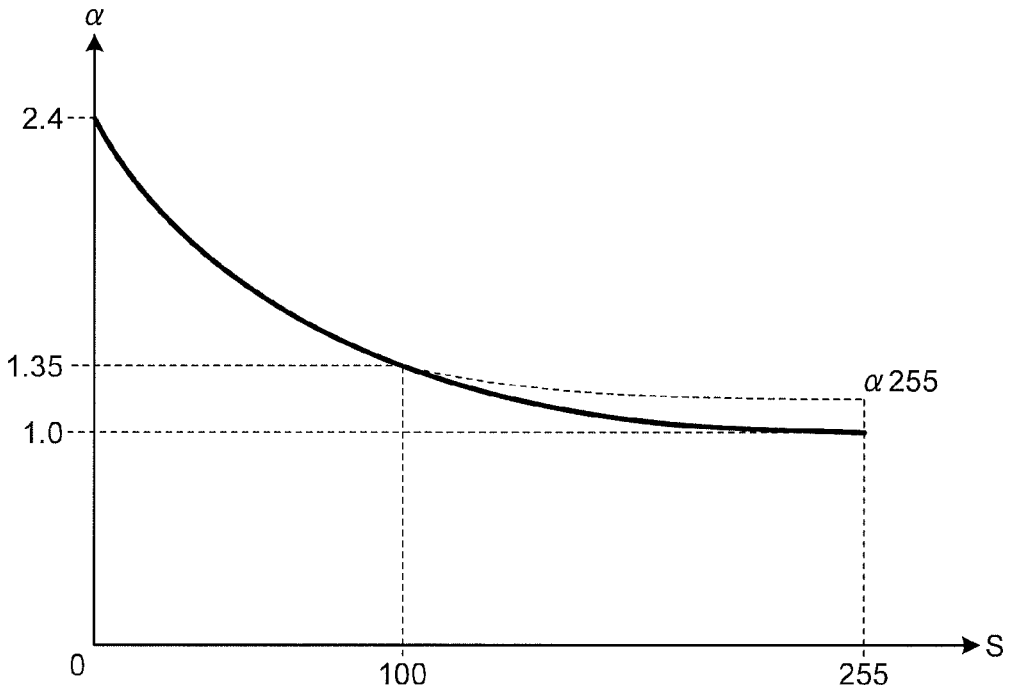
FIG. 12 is a diagram illustrating an example in which the expansion coefficient changes with change in the saturation.
Figure 13:
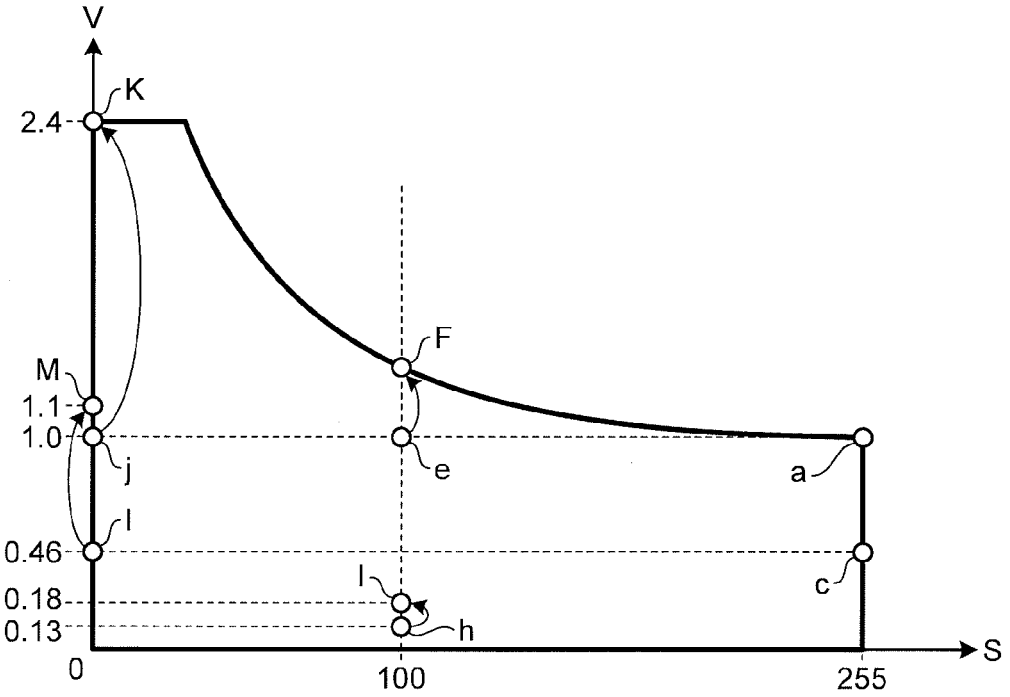
FIG. 13 is a diagram illustrating the HSV color space.

The following describes the calculation of the expansion coefficient α in the first embodiment. FIG. 12 is a diagram illustrating an example in which the expansion coefficient changes with change in the saturation. FIG. 13 is a diagram illustrating the HSV color space. A method for driving the display device according to the first embodiment is a method to change the expansion coefficient α based on the saturation S of an input signal as illustrated in FIG. 12. As a result, the expansion coefficient α varies based on the saturation S of the input signal. That is, the output signal varies based on the saturation S of the input signal in the first embodiment. In this example, as illustrated in FIG. 12, the expansion coefficient α is smaller for the signal value giving larger saturation S, and larger for the signal value giving smaller saturation S. In other words, the expansion coefficient α decreases as the saturation S increases.

When the expression (8) is used to linearize the signal value xa(R,G,B)=(255,255,0) that is the value of an input signal giving the saturation S of 255, the signal value xa is converted into (1,1,0), and is represented in the HSV color space by point a in FIG. 13. As illustrated in FIG. 12, the expansion coefficient α is 1.0 when the saturation S is 255. Hence, multiplying the signal value xa after the linearization by the expansion coefficient α of 1.0 gives a value (1,1,0) after the expansion, which is equal to that before the expansion, that is, which does not differ from the input value. As a result, the gradation collapse does not occur.

When the signal value xc(R,G,B)=(180,180,0) that is the value of an input signal giving the saturation S of 255 is linearized, the signal value xc is converted into (0.46,0.46, 0), and is represented in the HSV color space by point c in FIG. 13. Multiplying the signal value xc after the linearization by the expansion coefficient α of 1.0 gives a value (0.46,0.46,0) after the expansion, which is equal to that before the expansion, that is, which does not differ from the input value. As a result, the gradation collapse does not occur.

When the signal value xe(R,G,B)=(255,220,155) that is the value of an input signal giving the saturation S of 100 is linearized, the signal value xe is converted into (1.0,0.72, 0.33), and is represented in the HSV color space by point e in FIG. 13. As illustrated in FIG. 12, the expansion coefficient α is 1.35 when the saturation S is 100. Hence, multiplying the signal value xe after the linearization by the expansion coefficient α of 1.35 gives a value (1.35,0.977, 0.452) after the expansion. This value is a value at point F in FIG. 13. Point F resides in the HSV color space, so that the deterioration in display quality, such as the change in color, does not occur.

When the signal value xh(R,G,B)=(102,80,62) that is the value of an input signal giving the saturation S of 100 is linearized, the signal value xh is converted into (0.13,0.08, 0.045), and is represented in the HSV color space by point h in FIG. 13. Multiplying the signal value xh after the linearization by the expansion coefficient α of 1.35 gives a value (0.18,0.11,0.06) after the expansion. This value remains in the HSV color space (at point I in FIG. 13), so that the luminance ratio of R:G:B of the input does not differ from the luminance ratio of R:G:B of the output value obtained by the multiplication by the expansion coefficient α of 1.35, and point I resides in the HSV color space. Hence, the deterioration in display quality does not occur.

When the signal value xj(R,G,B)=(255,255,255) that is the value of an input signal giving the saturation S of 0 is linearized, the signal value xj is converted into (1,1,1), and is represented in the HSV color space by point j in FIG. 13. As illustrated in FIG. 12, the expansion coefficient α is 2.4 when the saturation S is 0. Hence, multiplying the signal value xj after the linearization by the expansion coefficient α of 2.4 gives a value (2.4,2.4,2.4) after the expansion. This value remains in the HSV color space (at point K in FIG. 13), so that the luminance ratio of R:G:B of the input does not differ from the luminance ratio of R:G:B of the output value obtained by the multiplication by the expansion coefficient α of 2.4, and point K resides in the HSV color space. Hence, the deterioration in display quality does not occur.

When the signal value xl(R,G,B)=(180,180,180) that is the value of an input signal giving the saturation S of 0 is linearized, the signal value xl is converted into (0.46,0.46, 0.46), and is represented in the HSV color space by point l in FIG. 13. Multiplying the signal value xl after the linearization by the expansion coefficient α of 2.4 gives a value (1.1,1.1,1.1) after the expansion. This value remains in the HSV color space (at point M in FIG. 13), so that the luminance ratio of R:G:B of the input does not differ from the luminance ratio of R:G:B of the output value obtained by the multiplication by the expansion coefficient α of 2.4, and point M resides in the HSV color space. Hence, the deterioration in display quality does not occur. That is, multiplying the signal values xj and xl giving S=0 by the expansion coefficient α (2.4 in the present example) keeps the values after the expansion always inside the HSV color space, so that the deterioration in display quality, such as the gradation collapse and/or the change in color, does not occur.

As described above, in the present embodiment, the display device 10 and the method for driving it change the expansion coefficient α based on the function of max and min of the input signal, that is, based on the saturation S defined by the expression (7) in the present embodiment, thereby increasing the luminance while keeping the display quality from deteriorating. The expression used for defining the saturation S of the signal value is not limited to the expression (7), but may be the following expression (9).

$$S=\max(R\text{in},G\text{in},B\text{in})-\min(R\text{in},G\text{in},B\text{in}) \tag{9}$$

The expression (9) represents an operation subtracting min(Rin,Gin,Bin) from max(Rin,Gin,Bin). In other words, the expression does not include a division operation, which complicates arithmetic processing. Hence, using the saturation S obtained by the expression (9) can simplify the arithmetic processing, thereby reducing a load on hardware. Using the expression (9) can also reduce the scale of an operational circuit.

While the example described above assumes the expansion coefficient α to be 1.0 when the saturation S is 255, the expansion coefficient α is not limited to this value. This is because, when the saturation is large (for example, S is 127 or larger), the display quality is hardly deteriorated by deviation of the signal value after the expansion from the HSV color space by a certain amount. Due to this, for example, the expansion coefficient α255 for the saturation S of 255 may be set to a value larger than 1.0 as illustrated in FIG. 12. While the expansion coefficient α is 2.4 when the saturation S is 0, the expansion coefficient α is not limited to this value, but an appropriate value can be used as α depending on the type or specifications of the display device 10, more specifically, the image display panel 40, illustrated in FIG. 1. An appropriate way can be used depending on the image display panel 40 as a way of changing the expansion coefficient α with respect to the saturation S. For example, the expansion coefficient α may be changed along the shape of the HSV color space illustrated in FIG. 13.

Figure 14:
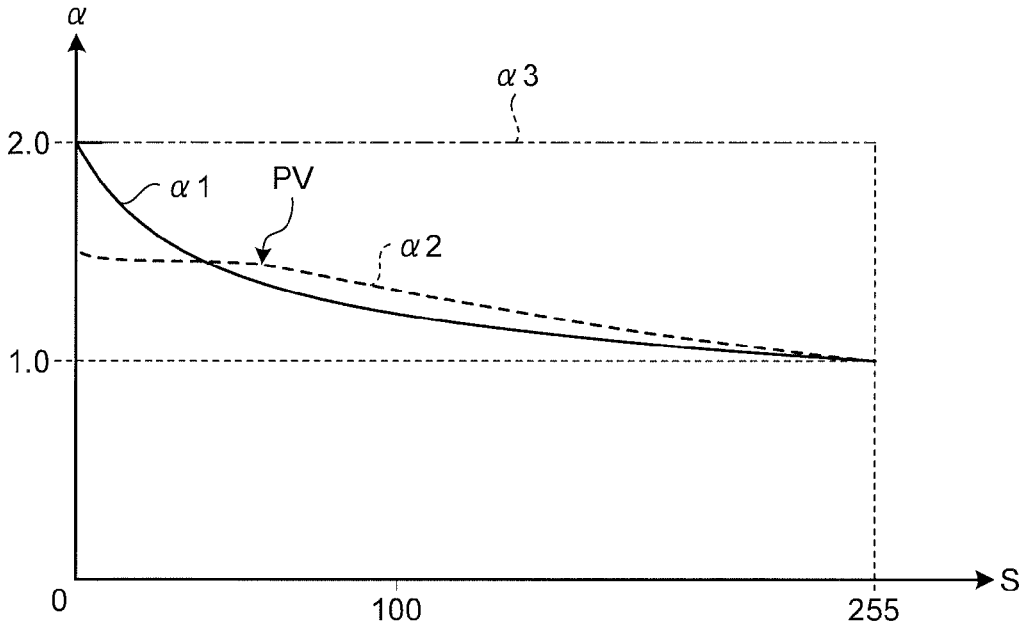
FIG. 14 is a diagram illustrating changes in the expansion coefficient with the change in the saturation.

FIG. 14 is a diagram illustrating changes in the expansion coefficient with the change in the saturation. FIG. 14 illustrates a plurality of relations each illustrating a relation between the expansion coefficient α and the saturation S. The relation between the expansion coefficient α and the saturation S indicated by α1 is a relation in which the expansion coefficient α decreases as the saturation S increases, as described above. The relation between the expansion coefficient α and the saturation S indicated by α2 is a relation in which the expansion coefficient α once decreases as the saturation S slightly increases from 0, and increases as the saturation S slightly increases until reaching a local maximum point PV, but thereafter decreases as the saturation S increases. In this way, the relation α2 has the local maximum point PV. The relation between the expansion coefficient α and the saturation S indicated by α3 is a relation in which the expansion coefficient α is constant (2.0 in this example) regardless of the change in the saturation S.

In the present embodiment, the display device 10 illustrated in FIG. 1 and the method for driving it may store a plurality of relations between the expansion coefficient α and the saturation S of the input signal, and may use the relations by switching thereamong. Specifically, the display device 10 can store, for example, α1, α2, and α3 mentioned above in a storage unit, and use them by switching thereamong according to conditions. This enables selection and use of an appropriate relation between the expansion coefficient α and the saturation S according to, for example, the aging of the image display panel 40, and can therefore more effectively reduce the deterioration in display quality.

Figure 15:
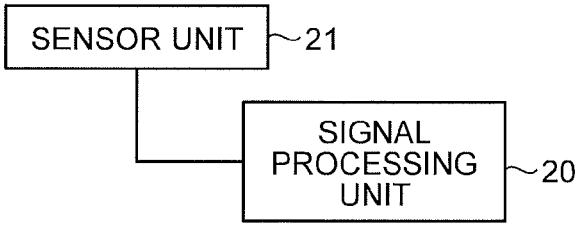
FIG. 15 is a block diagram illustrating arrangement of a sensor unit.

The display device 10 may switch the relation between the expansion coefficient α and the saturation S of the input signal depending on the external light intensity, for example, using a sensor unit 21 for measuring the external light intensity. FIG. 15 is a block diagram illustrating arrangement of the sensor unit 21. In this case, the display device 10 includes the sensor unit 21 coupled to the signal processing unit 20, as illustrated in FIG. 15. The sensor unit 21 measures the intensity of external light, and transmits the measured result to the signal processing unit 20. The signal processing unit 20 switches the relation between the expansion coefficient α and the saturation S of the input signal based on the external light intensity transmitted by the sensor unit 21. For example, when the external light intensity is high, the signal processing unit 20 switches the relation between the expansion coefficient α and the saturation S of the input signal so as to wholly reduce the expansion coefficient α.

The display device 10 may switch, based on the external light intensity, between a first display mode in which the expansion coefficient α changes based on the saturation S of the input signal and a second display mode in which the expansion coefficient α is kept at a constant value. The first display mode uses, for example, α1 of FIG. 14 as the relation between the expansion coefficient α and the saturation S of the input signal. The second display mode uses, for example, α3 of FIG. 14 as the relation between the expansion coefficient α and the saturation S of the input signal. The display device 10 uses the second display mode when the external light intensity is low. This allows the display device 10 to display a high-luminance image under a dark environment where the external light intensity is low.

Switching the relation between the expansion coefficient α and the saturation S of the input signal is not limited to this way, but may be switched by input from the observer.

The display device 10 according to the first embodiment is a reflective display device. An image on the reflective display device is darker than that, for example, on a transmissive display device, in some cases. However, the reflective display device consumes lower amount of power than the transmissive display device. Adding the fourth sub-pixel 49W to such a reflective display device to display the image can effectively brighten the image on the reflective display device that tends to display an image darkly. In addition, as described above, in the display device 10 according to the first embodiment, the expansion coefficient α changes with the saturation S, so that the output signal changes with the saturation S. As a result, the display device 10 according to the first embodiment can reduce the deterioration in display quality, such as the gradation collapse and/or the change in color. That is, in the reflective display device that tends to display an image darkly, the display device 10 according to the first embodiment can appropriately brighten the image while reducing the deterioration in display quality.

More specifically, the display device 10 according to the first embodiment reduces the expansion coefficient α as the saturation S increases. The display device 10 according to the first embodiment performs the expansion processing on the signal value of the image by a larger factor on the lower-saturation side where the gradation collapse is less likely to occur and by a smaller factor on the higher-saturation side where the gradation collapse is more likely to occur, thereby brightening the image while more appropriately reducing the degradation of the image.

Moreover, the display device 10 according to the first embodiment can store therein a plurality of relations between the expansion coefficient α and the saturation S, and can use them by switching thereamong. As a result, the display device 10 according to the first embodiment can brighten the image, for example, depending on the external light intensity, while appropriately reducing the degradation of the image.

2. First Modification

The following describes a first modification of the first embodiment. In general, human sensitivity is particularly high to the deterioration in the display quality of yellowish pictures. For this reason, the hue H may be taken into consideration. The first modification changes the expansion coefficient α based on the saturation S and the hue H of the input signal. In the first modification, the hue is defined using the following expressions (10) to (12). Specifically, the hue H is given by the expression (10) when the value of R is the maximum of (R,G,B), by the expression (11) when the value of G is the maximum of (R,G,B), or by the expression (12) when the value of B is the maximum of (R,G,B). Min represents min(Rin,Gin,Bin) given above, and Max represents max(Rin,Gin,Bin) given above. The definitions of the hue H are not limited to these expressions.

$$H=60\cdot(G-B)/(\text{Max}-\text{Min}) \tag{10}$$

$$H=60\cdot(B-R)/(\text{Max}-\text{Min})+120 \tag{11}$$

$$H=60\cdot(R-G)/(\text{Max}-\text{Min})+240 \tag{12}$$

A range of the hue H from 40 to 80 is defined as a range of yellow in the first modification. The hue H representing yellow is, however, not limited to be in this range. A display device 10*a* according to the first modification reduces the expansion coefficient α, for example, for the input signal giving the hue H corresponding to yellow, and increases the expansion coefficient α, for example, for the input signal giving a color other than yellow, that is, giving the hue H outside the range from 40 to 80.

More specifically, the display device 10*a* according to the first modification may adjust the expansion coefficient α so as to change based on the saturation S of the input signal (for example, along α1 of FIG. 14) when the input signal gives the hue H corresponding to yellow, and keep the expansion coefficient α constant regardless of the saturation S (for example, along α3 of FIG. 14) when the input signal gives a color other than yellow, that is, the hue H outside the range from 40 to 80. In other words, the display device 10*a* selects the above-described first display mode when the hue H of the input signal corresponds to yellow, and selects the above-described second display mode when the hue H of the input signal is corresponds to a color other than yellow.

In this case, if the color based on the hue H is yellow, the first display mode is used in which the expansion coefficient α changes, or if the color is other than yellow, the second display mode is used in which the expansion coefficient α is constant. Thus, the expansion coefficient α changes based on the hue H. In the first display mode, the expansion coefficient α changes based on the saturation S. In this way, the expansion coefficient α changes based on at least one of the saturation S and the hue H of the input signal.

With the first modification, the display device 10*a* according to the first modification can expand the input signal while effectively reducing the deterioration in display quality with respect to yellow that is more visible to human sense as to the deterioration in display quality. The first modification keeps the expansion coefficient α constant regardless of the saturation S with respect to the hue of a color that is less visible as to the deterioration in display quality, that is, the hue of a color other than yellow, thereby more increasing the luminance. As a result, the display device 10*a* according to the first modification can output a video picture in which the deterioration in display quality is less visible, and that has high luminance.

The display device 10*a* according to the first modification changes the expansion coefficient α based on the hue H of the input signal, thereby increasing the luminance while reducing the deterioration in display quality of a color, such as yellow, that is more visible as to the deterioration in display quality. The first embodiment and the first modification thereof change the expansion coefficient α based on the saturation S and the hue H of the input signal, thereby reducing the deterioration in display quality of a color (such as yellow) that is easily visible as to the deterioration in display quality, and also reducing the deterioration in display quality on the higher-saturation side. The lowering of visibility can be reduced by increasing the luminance. The first embodiment and the first modification thereof change the expansion coefficient α in response to the saturation S, so that the extension coefficient α may vary depending on the position of the image displayed on the image display panel 40 of each of the display device 10 and the display device 10*a*.

3. Second Modification

The following describes a second modification of the first embodiment. A display device 10*b* according to the second modification is a reflective display device that is of a front light type and includes light source units 50*b* of a direct type. With respect to the rest of the display device 10*b* according to the second modification, the configuration is common to that of the display device 10 according to the first embodiment, so that the description thereof is omitted.

Figure 16:
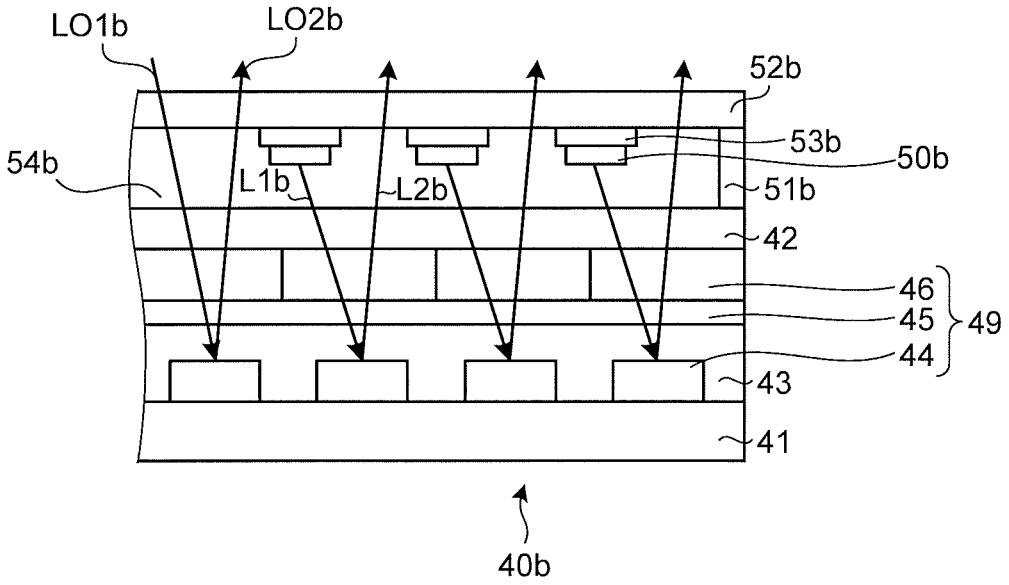
FIG. 16 is a sectional view schematically illustrating a structure of an image display panel according to a second modification.

FIG. 16 is a sectional view schematically illustrating a structure of an image display panel according to the second modification. As illustrated in FIG. 16, a light source substrate 52*b* is mounted on a surface of the counter substrate 42 of an image display panel 40*b* opposite to the liquid crystal layer 43 side, with a support base 51*b* interposed between the surface and the light source substrate 52*b*. The support base 51*b* provides a space 54*b* between the counter substrate 42 and the light source substrate 52*b*.

The light source substrate 52*b* is a transparent substrate, such as a glass substrate. The light source units 50*b* are provided on a surface of the light source substrate 52*b* facing the space 54*b* with a plurality of light-shielding parts 53*b* interposed between the light source units 50*b* and the light source substrate 52*b*. The light-shielding parts 53*b* are members of, for example, light-shielding metal. The light-shielding parts 53*b* keep light from the light source units 50*b* from directly exiting to the outside through the light source substrate 52*b*. The light-shielding parts 53*b* may be reflecting members having reflectivity. The light source units 50*b* are coupled to the signal processing unit 20 through metal wiring or wiring containing, for example, a translucent conductive material. In the second modification, the light source units 50*b* are LEDs, but may be, for example, organic electroluminescent light sources.

The following describes reflection of light by the image display panel 40*b* according to the second modification. As illustrated in FIG. 16, light L1*b* from each of the light source units 50*b* is incident from the counter substrate 42 side of the image display panel 40*b* on the image display panel 40*b*, and is projected on the pixel electrode 44. The light L1*b* projected on the pixel electrode 44 is reflected by the pixel electrode 44, and exits, as light L2*b*, to the outside through the image display panel 40*b* and the light source substrate 52*b*. External light LO1*b* is incident on the image display panel 40*b*. The external light LO1*b* is incident on each of the pixel electrodes 44 through the light source substrate 52*b* and the image display panel 40*b*. The external light LO1*b* incident on the pixel electrode 44 is reflected by the pixel electrode 44, and exits, as light LO2*b*, to the outside through the image display panel 40*b* and the light source substrate 52*b*.

In other words, the pixel electrodes 44 reflect, toward the outside, the light L1*b* and/or the external light LO1*b* incident on the image display panel 40*b* from the front surface thereof that is a surface on the external side (the counter substrate 42 side) of the image display panel 40*b*. The light L2*b* and/or the light LO2*b* reflected toward the outside pass(es) through the liquid crystal layer 43 and the color filters 46. Due to this, the display device 10*b* can display an image with the light L2*b* and/or the light LO2*b* reflected toward the outside. As described above, the display device 10*b* according to the second modification is a reflective display device that is of a front light type and includes the light source units 50*b* of a direct type. Also with the configuration as described above, the display device 10*b* according to the second modification changes the expansion coefficient α based on the saturation S, thereby brightening the image while keeping the display quality from deteriorating on the reflective display device that tends to display images darkly.

4. Second Embodiment

The following describes a second embodiment of the present invention. A display device 10*c* according to the second embodiment differs from the display device 10 according to the first embodiment in that a signal processing unit 20*c* of the display device 10*c* converts the input signal into an input signal after conversion and then expands the input signal after conversion. Description is omitted for configurations of the display device 10*c* according to the second embodiment common to those of the display device 10 according to the first embodiment.

Figure 17:
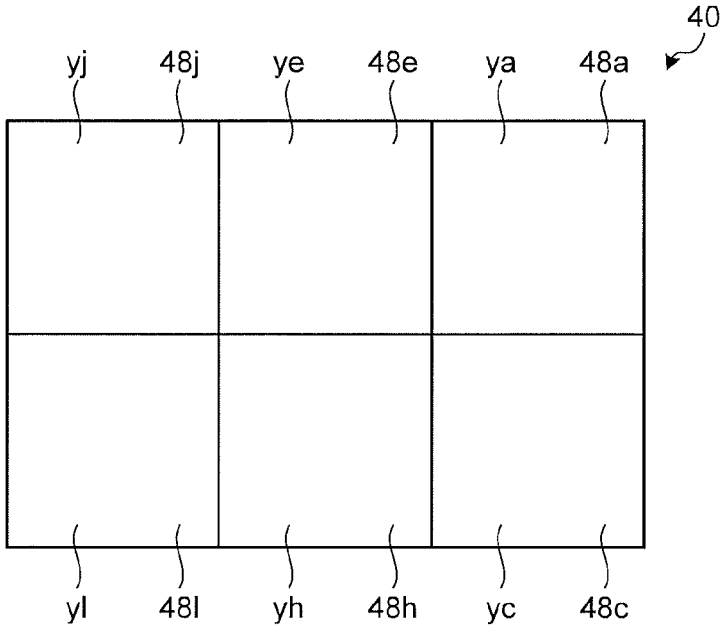
FIG. 17 is a diagram for explaining input values to the respective pixels in a second embodiment.
Figure 18:
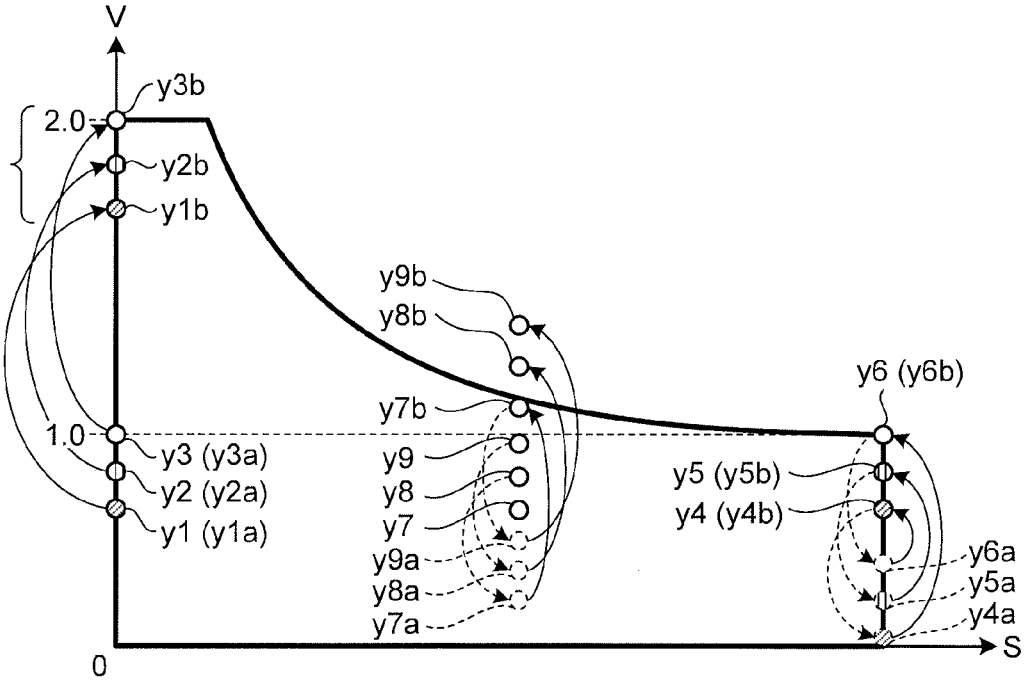
FIG. 18 is a diagram illustrating an example in which input signals change with the saturation in the second embodiment.
Figure 19:
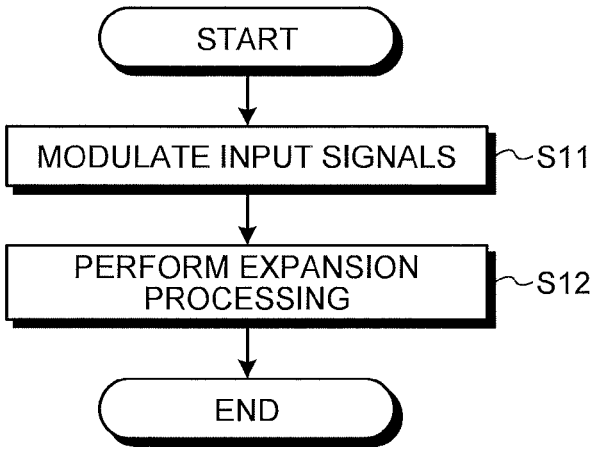
FIG. 19 is a flowchart for explaining a processing procedure of color conversion processing according to the second embodiment.

FIG. 17 is a diagram for explaining input values to the respective pixels in the second embodiment. FIG. 18 is a diagram illustrating an example in which input signals change with the saturation in the second embodiment. FIG. 19 is a flowchart for explaining a processing procedure of color conversion processing according to the second embodiment. The following describes the color conversion processing performed by the signal processing unit 20*c* according to the second embodiment, based on the flowchart of FIG. 19.

In the case of performing the color conversion processing, the signal processing unit 20*c* modulates input signals to generate input signals after conversion (Step S11). FIG. 17 illustrates that signal values ya, yc, ye, yh, yj, and yl are supplied to the pixels 48*a*, 48*c*, 48*e*, 48*h*, 48*j*, and 48*l*, respectively, included in the image display panel 40. For example, one of signal values y1, y2, y3, y4, y5, y6, y7, y8, and y9 illustrated in FIG. 18 is converted into an input value after conversion, and the input value after conversion is expanded with the expansion coefficient α that is 2.0 regardless of change in the saturation S to be output as each of the signal values ya, yc, ye, yh, yj, and yl.

Specifically, the signal processing unit 20*c* first calculates the input value after conversion by performing the conversion using a function f(S) for reducing the brightness V of one of the signal values y1, y2, y3, y4, y5, y6, y7, y8, and y9 in FIG. 18 at a constant rate in response to the saturation S. The function f(S) is represented by, for example, the following expression (13).

$$f(S)=V\times[(-1/510)\times S+1] \quad (13)$$

As illustrated in FIG. 18, the signal value y1 giving the saturation S of 0 and the brightness V of 0.8, the signal value y2 giving the saturation S of 0 and the brightness V of 0.9, and the signal value y3 giving the saturation S of 0 and the brightness V of 1.0 are converted based on the expression (13) into values after the conversion (values of the input signals after conversion) y1*a*, y2*a*, and y3*a*, which give the brightness V of 0.8, the brightness V of 0.9, and the brightness V of 1.0, respectively.

As illustrated in FIG. 18, the signal value y4 giving the saturation S of 255 and the brightness V of 0.8, the signal value y5 giving the saturation S of 255 and the brightness V of 0.9, and the signal value y6 giving the saturation S of 255 and the brightness V of 1.0 are converted based on the expression (13) into values after the conversion (values of the input signals after conversion) y4*a*, y5*a*, and y6*a*, which give the brightness V of 0.4, the brightness V of 0.45, and the brightness V of 0.5, respectively.

As illustrated in FIG. 18, the signal value y7 giving the saturation S of 170 and the brightness V of 0.8, the signal value y8 giving the saturation S of 170 and the brightness V of 0.9, and the signal value y9 giving the saturation S of 170 and the brightness V of 1.0 are converted based on the expression (13) into values after the conversion (values of the input signals after conversion) y7*a*, y8*a*, and y9*a*, which give the brightness V of 0.53, the brightness V of 0.6, and the brightness V of 0.67, respectively.

Then, the signal processing unit 20*c* performs the signal expansion processing based on the four sub-pixels (Step S12). That is, the signal processing unit 20*c* expands the input signals after conversion with the expansion coefficient α. In this case, the expansion coefficient α is constant regardless of the change in the saturation S, and is also constant among frames. The signal processing unit 20*c* performs the expansion processing while setting the expansion coefficient α to 2.0. However, the expansion coefficient α may be any value provided that the expansion coefficient α is constant regardless of the change in the saturation S and is also constant among frames.

Specifically, for example, in the case of the input signals giving the saturation S of 0, values y1*b*, y2*b*, and y3*b* after the expansion of the signal values y1*a*, y2*a*, and y3*a* give the brightness V of 1.6, the brightness V of 1.8, and the brightness V of 2.0, respectively, as illustrated in FIG. 18. In this case, as illustrated in FIG. 18, all the values y1*b*, y2*b*, and y3*b* after the expansion reside in the color space, hence causing no problem while increasing the luminance.

In the case of the input signals giving the saturation S of 255, values y4*b*, y5*b*, and y6*b* after the expansion of the signal values y4*a*, y5*a*, and y6*a* give the brightness V of 0.8, the brightness V of 0.9, and the brightness V of 1.0, respectively. In this case, as illustrated in FIG. 18, all the values y4*b*, y5*b*, and y6*b* after the expansion reside in the color space, hence causing no problem while increasing the luminance.

In the case of the input signals giving the saturation S of 170, values y7*b*, y8*b*, and y9*b* after the expansion of the signal values y7*a*, y8*a*, and y9*a* give the brightness V of 1.06, the brightness V of 1.2, and the brightness V of 1.34, respectively. In this case, as illustrated in FIG. 18, y7*b* out of the values y7*b*, y8*b*, and y9*b* after the expansion resides in the color space. The signal processing unit 20*c* finishes the color conversion processing by performing the signal expansion processing based on the four sub-pixels.

As described above, in the case of also outputting the output signal to the fourth sub-pixel 49W, the signal processing unit 20*c* generates the input signals after conversion from the input signals so as to reduce the level of the brightness V of at least the input signals giving the saturation S equal to or higher than a certain level. The signal processing unit 20*c* then calculates the output signals for the first, the second, and the third sub-pixels 49R, 49G, and 49B, based on the input signals after conversion and the expansion coefficient α that defines the amount of the brightness to be increased by the light source unit 50 and the fourth sub-pixel 49W. The saturation S equal to or higher than a certain level is preferably at most 50 or higher, and more preferably 30 or higher.

Figure 20:
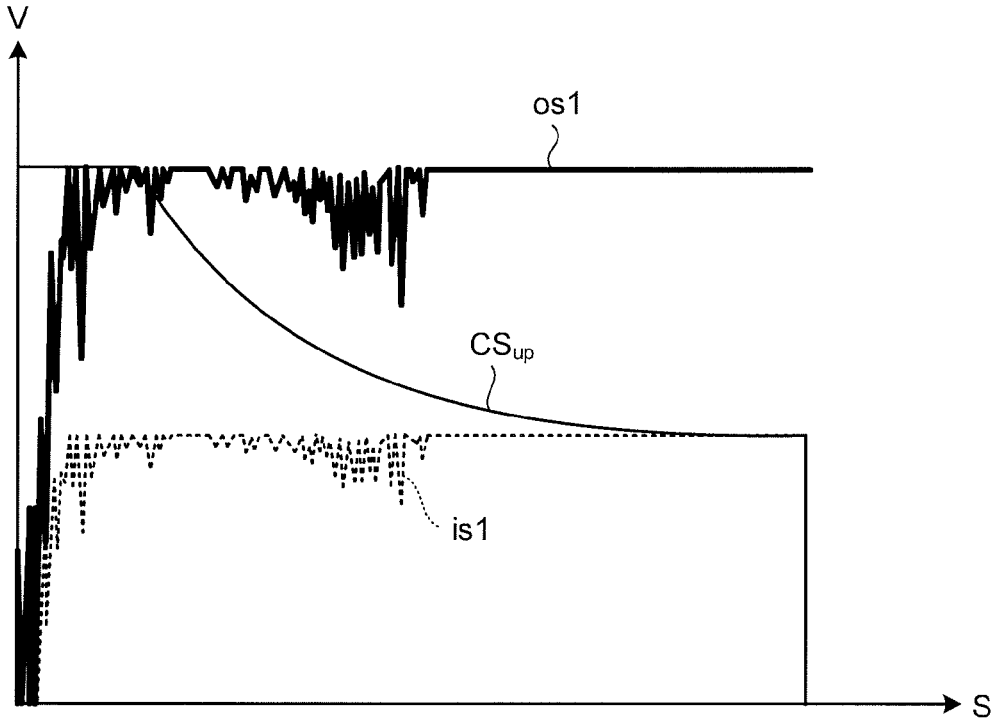
FIG. 20 is a diagram illustrating, in the HSV color space, the input signal values before and after being expanded by the expansion coefficient.
Figure 21:
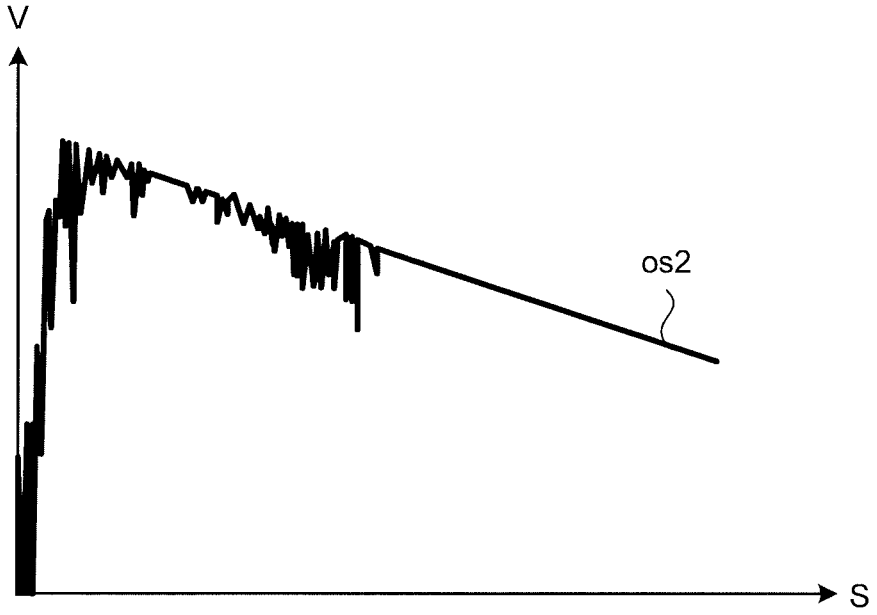
FIG. 21 is a diagram illustrating an example in which an input signal after conversion has been expanded.
Figure 22:
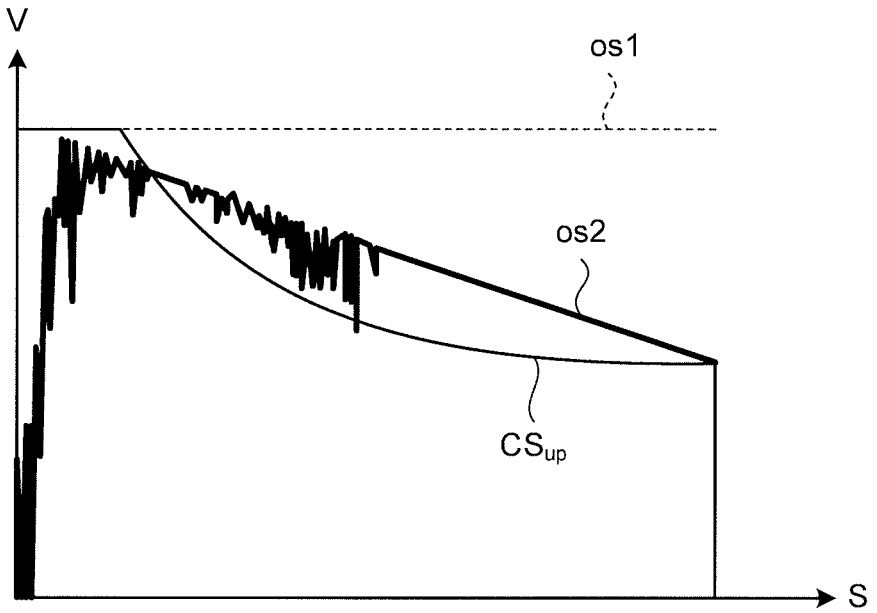
FIG. 22 is a diagram illustrating relations between expanded values obtained by expanding the input signals after conversion of the second embodiment and the HSV color space.

FIG. 20 is a diagram illustrating, in the HSV color space, the input signal values before and after being expanded by the expansion coefficient. FIG. 21 is a diagram illustrating an example in which the input signal after conversion has been expanded. FIG. 22 is a diagram illustrating relations between expanded values obtained by expanding the input signals after conversion of the second embodiment and the HSV color space. FIG. 20 illustrates a case in which the modulation processing according to the second embodiment is not performed (the input signal after conversion is not generated), and an input signal is1 is expanded by a constant expansion coefficient. The HSV color space expanded by introducing therein the fourth color component (white) has a brightness upper limit value $CS_{up}$ obtained by connecting maximum values Vmax(S) of the brightness determined by using the saturation S as a variable. When the input signal is1 is assumed to be an input signal (input value of RGB data) of each of the pixels 48 that can be displayed with the first color component, the second color component, and the third color component, a value os1 after the expansion of the input signal is1 increases the brightness V by a factor of the expansion coefficient α (=2.0) that is always constant with respect to the saturation S. However, the gradation information corresponding to an excess over the brightness upper limit value $CS_{up}$ is totally lost, and thus, the gradation collapse occurs.

Compared with this, the signal processing unit 20*c* according to the second embodiment expands the input value after conversion with the constant expansion coefficient α of 2.0 to generate the value os2 after the expansion, as illustrated in FIG. 21. According to a comparison between the value os2 after the expansion obtained by expanding the input value after conversion and the value os1 after the expansion obtained by expanding the unmodulated input signal, the amount of the value os2 after the expansion which exceeds the brightness upper limit value $CS_{up}$ is smaller than that of the value os1 after the expansion exceeds the brightness upper limit value $CS_{up}$, as illustrated in FIG. 22. Hence, the loss of the gradation information is reduced, and the gradation collapse is kept from occurring.

In the second embodiment, the function f(S) for calculating the input signal after conversion from the input signal is a linear function. The linear function represented by the expression (13) is an example, and is not limited to this. For example, the function f(S) can be one of tangent lines to the curve of the brightness upper limit value $CS_{up}$ so as to form a straight line that represents the brightness changing with respect to the saturation S along the curve of the brightness upper limit value $CS_{up}$.

Figure 23:
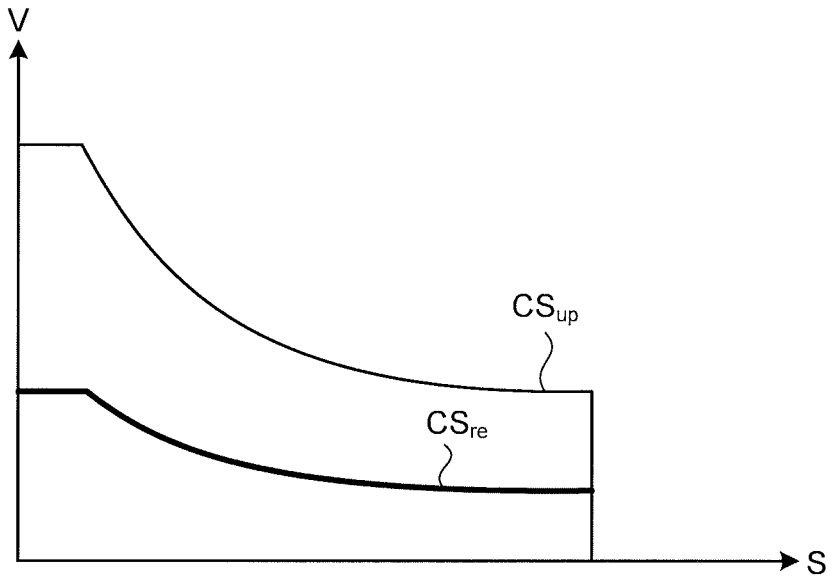
FIG. 23 is a diagram illustrating another example in which the input signals change with the saturation.
Figure 24:
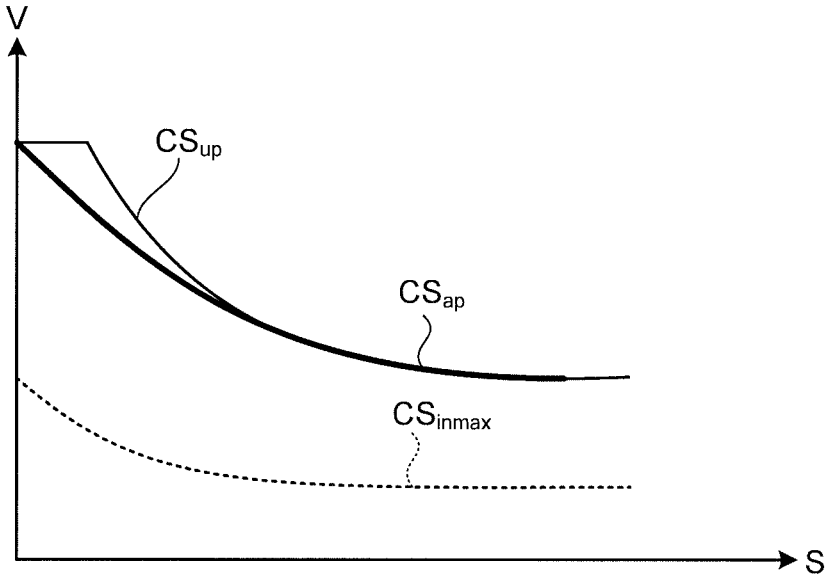
FIG. 24 is a diagram illustrating relations between the expanded values obtained by expanding the input signals after conversion and the HSV color space in the other example of the second embodiment.

The function f(S) is not limited to a linear function mentioned above. The brightness upper limit value $CS_{up}$ may be a higher-degree function. FIG. 23 is a diagram illustrating another example in which the input signals change with the saturation. FIG. 24 is a diagram illustrating relations between the expanded values obtained by expanding the input signals after conversion and the HSV color space in the other example of the present embodiment.

As illustrated in FIG. 23, the HSV color space expanded by introducing therein the fourth color component (white) has the brightness upper limit value $CS_{up}$ obtained by connecting the maximum values Vmax(S) of the brightness determined by using the saturation S as a variable. The signal processing unit 20*c* divides the brightness of the input signals by the maximum value of the brightness in the expanded HSV color space, that is, by the brightness upper limit value $CS_{up}$ as a function of the saturation to perform the modulation processing (refer to Step S11 illustrated in FIG. 19) on the input signals to limit the maximum value of the input signals to $CS_{re}$ or smaller. Thereafter, the signal processing unit 20*c* performs the signal expansion processing based on the four sub-pixels (Step S12), but the brightness after the expansion does not exceed the brightness upper limit value $CS_{up}$. Because of this, the value after the expansion resides in the color space over the entire range, hence causing no problem while increasing the luminance.

The color conversion processing in the other example of the present embodiment will be described more specifically using FIG. 24. As illustrated in FIG. 24, the brightness upper limit value $CS_{up}$ as a function of the saturation has a breaking point. Now, the following expression (14) for representing an approximate value $CS_{ap}$ of the upper limit value $CS_{up}$ is obtained.

$$CS_{ap}(S)=-4.929\times10^{-8}\times S^3+4.901\times10^{-5}\times S^2-1.473\times10^{-2}\times S+k \quad (14)$$

where k represents the maximum value of the brightness when the saturation is 0, and is, for example, 2.4.

The input signal is converted by the following expression (15), based on the expression (14).

$$f(S)=CS_{ap}(S)/k \quad (15)$$

As a result, a maximum value $CS_{inmax}$ of the input signals after conversion results in $CS_{re}$ or smaller.

As described above, the input signals after conversion are obtained by the conversion using the function f(S) that reduces the brightness of the input signals to equal to or less than a value obtained by dividing the maximum value of the brightness of the input signals by the maximum value of the brightness in the HSV color space expanded by introducing therein the fourth color component.

In this way, the signal processing unit 20*c* expands the input value after conversion with the constant expansion coefficient α of 2.0. The value after the expansion does not exceed the brightness upper limit value $CS_{up}$. Hence, the loss of the gradation information is reduced, and the gradation collapse is kept from occurring.

In the method for driving the display device according to the second embodiment, the expansion coefficient α is constant (for example, α=2.0) regardless of the level of the saturation S. The expansion coefficient α may, however, be changed based on the saturation S of the input signal. This causes the expansion coefficient α to change based on the saturation S of the input signal. In this example, the expansion coefficient α is smaller for the signal value giving larger saturation S, and larger for the signal value giving smaller saturation S. In other words, the expansion coefficient α decreases as the saturation S increases. The display device 10*c* and the method for driving it change the expansion coefficient α based on the function of max and min of the input signal, that is, based on the saturation S defined by the expression (7) in the present embodiment, thereby increasing the luminance while keeping the display quality from deteriorating. In the same way as in the first embodiment, the expression used for defining the saturation of the signal value is not limited to the expression (7), but may be the expression (9) given above.

The signal processing unit 20*c* may change the value of the expansion coefficient α, for example, based on the external light intensity. In this case, the signal processing unit 20*c* may measure the external light intensity, for example, using the sensor unit 21 included in the display device illustrated in the first embodiment, to change the value of the expansion coefficient α, or may change the value of the expansion coefficient α based on the input from the observer.

In this way, the signal processing unit 20*c* according to the second embodiment generates the input signals after conversion from the input signals so as to reduce the level of the brightness of at least the input signals giving the saturation at a certain level or higher, and generates the output signals based on the input signals after conversion. That is, the signal processing unit 20*c* according to the second embodiment obtains the output signals that change with the saturation. As a result, in the reflective display device that tends to display an image darkly, the signal processing unit 20*c* can appropriately brighten the image while reducing the deterioration in display quality, such as the gradation collapse and/or the change in color. More specifically, the display device 10*c* obtains the input signals after conversion through the conversion using the function that reduces the brightness of the input signals at a constant rate depending on the saturation. As a result, the display device 10*c* according to the second embodiment performs the expansion processing on the signal value of the image by a larger factor on the lower-saturation side where the gradation collapse is less likely to occur and by a smaller factor on the higher-saturation side where the gradation collapse is more likely to occur, thereby brightening the image while more appropriately reducing the degradation of the image.

The signal processing unit 20*c* according to the second embodiment keeps the expansion coefficient α constant. As a result, the display device 10*c* according to the second embodiment need not calculate the expansion coefficient α frame by frame, thereby reducing the processing load.

Figure 25:
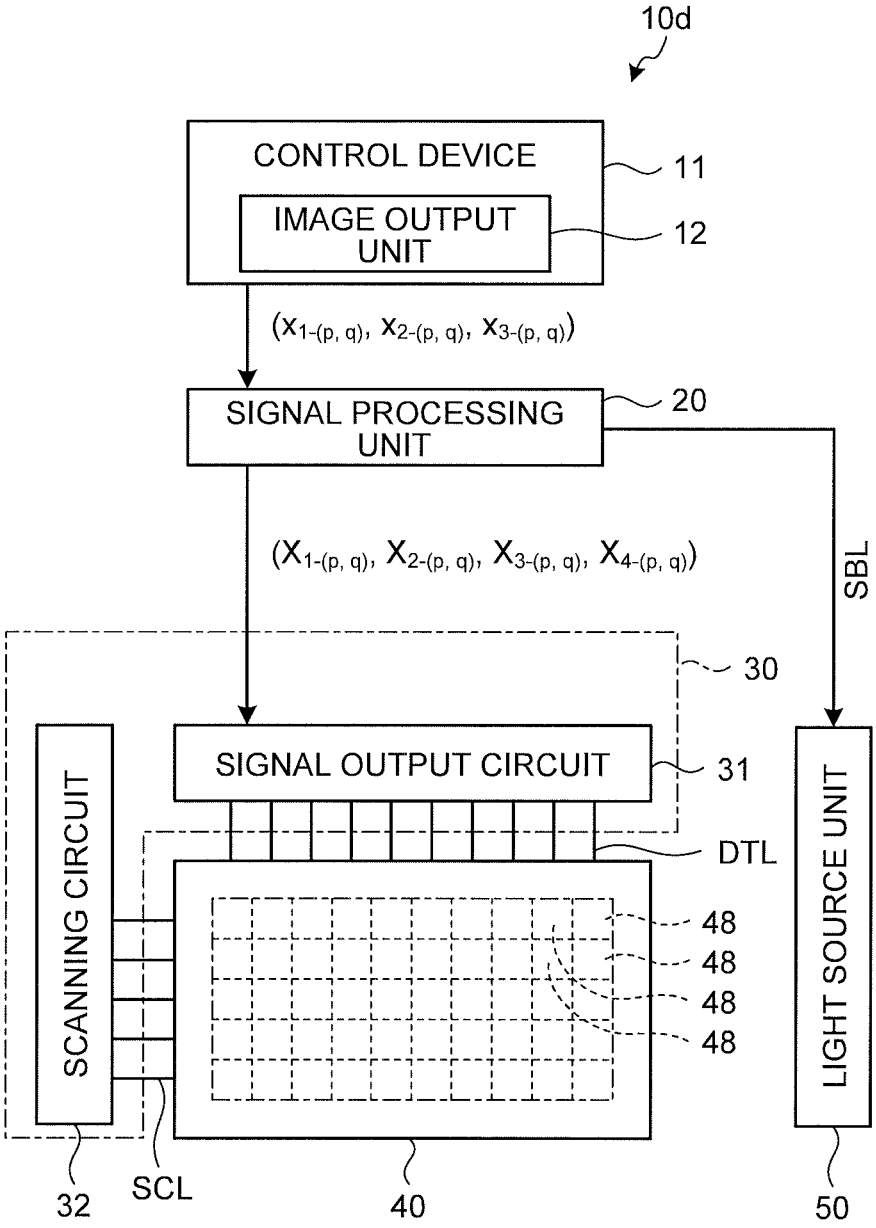
FIG. 25 is a block diagram illustrating another example of the configuration of the display device according to the first embodiment.
Figure 26:
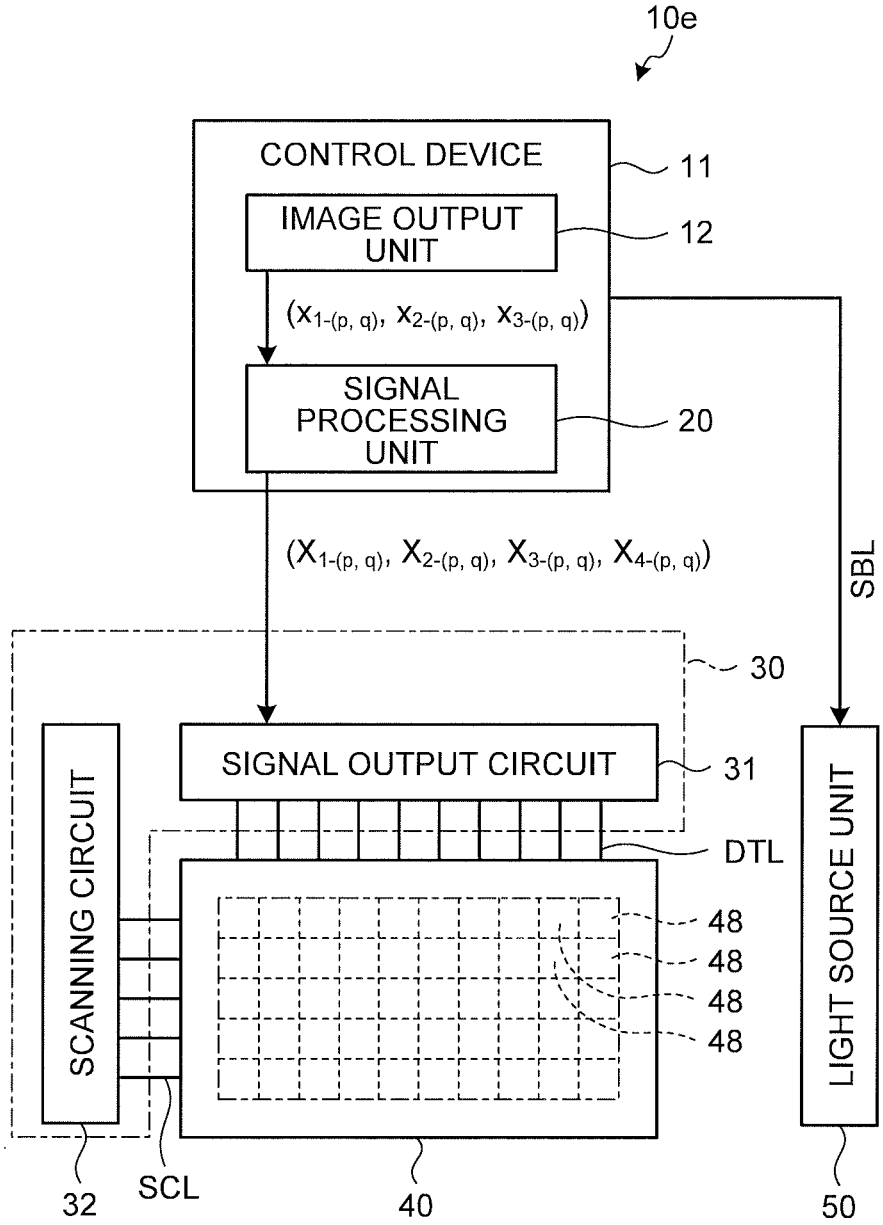
FIG. 26 is a block diagram illustrating still another example of the configuration of the display device according to the first embodiment.

FIGS. 25 and 26 are block diagrams illustrating other examples of the configuration of the display device according to the first embodiment. A display device 10*d* according to another example illustrated in FIG. 25 includes a control device 11 that outputs the input signals to the signal processing unit 20. The control device 11 includes an image output unit 12, and the image output unit 12 outputs the input signals to the signal processing unit 20. In a display device 10*e* according to still another example illustrated in FIG. 26, the signal processing unit 20 is a part of the control device 11. When the signal processing unit 20 is a part of the control device 11, the signal processing unit 20 can process the input signals by only performing the processing in the control device 11.

5. Application Examples

Figure 27:
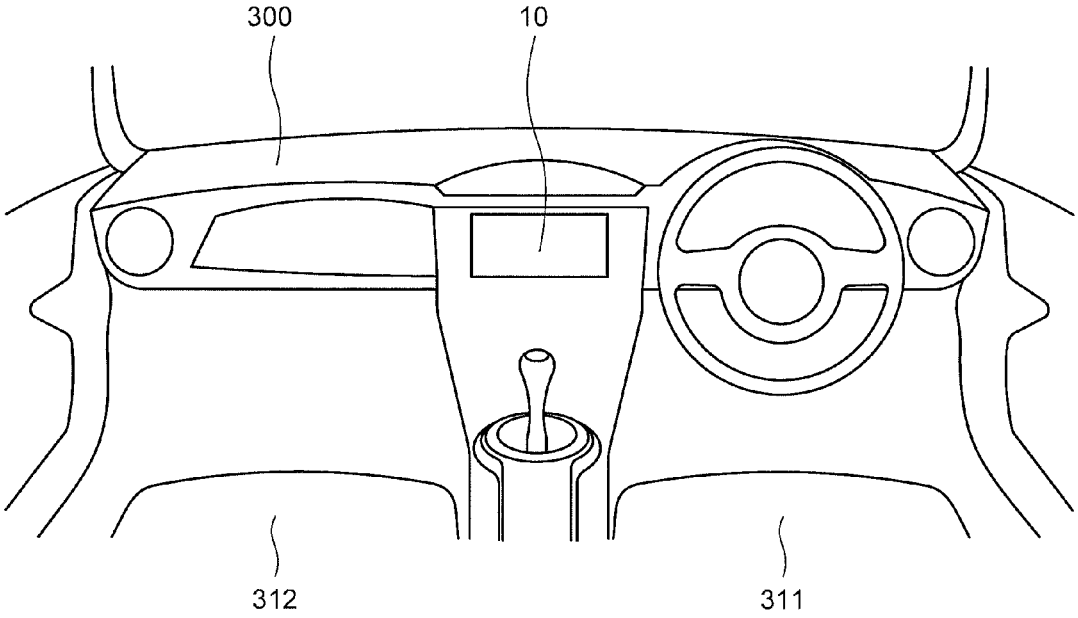
FIG. 27 is a diagram illustrating an example of an electronic apparatus to which the display device according to the first embodiment is applied.
Figure 28:
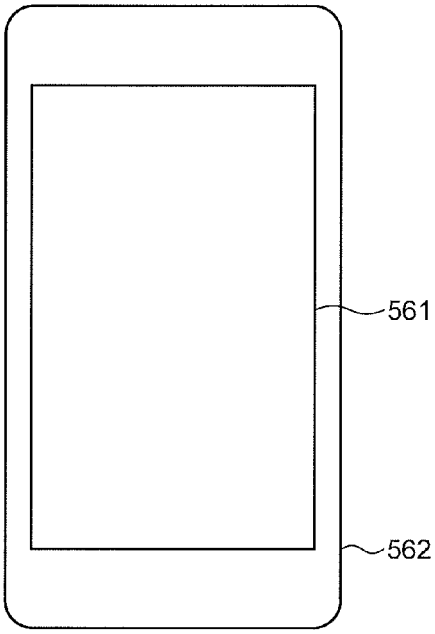
FIG. 28 is a diagram illustrating an example of an electronic apparatus to which the display device according to the first embodiment is applied.

The following describes application examples of the display device 10 described in the first embodiment with reference to FIGS. 27 and 28. FIGS. 27 and 28 are diagrams illustrating examples of an electronic apparatus to which the display device according to the first embodiment is applied. The display device 10 according to the first embodiment can be applied to electronic apparatuses in various fields, such as automotive navigation systems such as one illustrated in FIG. 27, television devices, digital cameras, laptop computers, portable electronic apparatuses including mobile phones such as one illustrated in FIG. 28, and video cameras. In other words, the display device 10 according to the first embodiment can be applied to electronic apparatuses in various fields that display externally received video signals or internally generated video signals as images or videos. Each of such electronic apparatuses includes the control device 11 (refer to FIG. 25) that supplies video signals to the display device and controls operations of the display device. The application examples given here can be applied to, in addition to the display device 10 according to the first embodiment, the display devices according to the other embodiments, the modification, and the other examples described above.

The electronic apparatus illustrated in FIG. 27 is an automotive navigation device to which the display device 10 according to the first embodiment is applied. The display device 10 is installed on a dashboard 300 in the interior of an automobile. Specifically, the display device 10 is installed between a driver seat 311 and a passenger seat 312 on the dashboard 300. The display device 10 of the automotive navigation device is used for navigation display, display of an audio control screen, reproduction display of a movie, or the like.

The electronic apparatus illustrated in FIG. 28 is a portable information apparatus to which the display device 10 according to the first embodiment is applied. The portable information apparatus operates as a portable computer, a multifunctional mobile phone, a mobile computer allowing a voice communication, or a communicable portable computer, and is sometimes called a smartphone or a tablet terminal. The portable information apparatus includes, for example, a display unit 561 on a surface of a housing 562. The display unit 561 includes the display device 10 according to the first embodiment, and has a touch detection (what is called a touch panel) function that enables detection of an external proximity object.

While the embodiments and the modification of the present invention have been described above, the embodiments and the like are not limited to the contents thereof. The components described above include components easily conceivable by those skilled in the art, substantially the same components, and components in the range of what are called equivalents. The components described above can also be appropriately combined with each other. In addition, the components can be variously omitted, replaced, or modified without departing from the gist of the embodiments and the like described above. The display device 10 may include, for example, a self-luminous image display panel in which self-luminous bodies such as organic light-emitting diodes (OLEDs) are lit.

What is claimed is:

1. A display device comprising:

an image display panel in which pixels are arranged in a two-dimensional matrix, each of the pixels including a first sub-pixel that displays a first color, a second sub-pixel that displays a second color, a third sub-pixel that displays a third color, and a fourth sub-pixel that displays a fourth color; and a signal processing unit that converts input values of input signals into extended values in a color space extended with the first color, the second color, the third color, and the fourth color to generate output signals, and outputs the generated output signals to the image display panel, wherein each of the first sub-pixel, the second sub-pixel, the third sub-pixel, and the fourth sub-pixel includes a pixel electrode that is supplied with a video signal and reflects light incident thereon from a front surface of the image display panel, the signal processing unit obtains an output signal for the first sub-pixel based on at least an input signal of the first sub-pixel and an expansion coefficient and outputs the obtained output signal to the first sub-pixel, obtains an output signal for the second sub-pixel based on at least an input signal of the second sub-pixel and the expansion coefficient and outputs the obtained output signal to the second sub-pixel, obtains an output signal for the third sub-pixel based on at least an input signal of the third sub-pixel and the expansion coefficient and outputs the obtained output signal to the third sub-pixel, and obtains an output signal for the fourth sub-pixel based on the input signal of the first sub-pixel, the input signal of the second sub-pixel, the input signal of the third sub-pixel, and the expansion coefficient and outputs the obtained output signal to the fourth sub-pixel; and the signal processing unit changes the output signal for the first sub-pixel, the output signal for the second sub-pixel, the output signal for the third sub-pixel, and the output signal for the fourth sub-pixel based on at least saturation of the input signals, wherein the signal processing unit changes the expansion coefficient based on at least the saturation of the input signals, so that the signal processing unit changes the output signal for the first sub-pixel, the output signal for the second sub-pixel, the output signal for the third sub-pixel, and the output signal for the fourth sub-pixel based on the saturation of the input signals, and wherein the signal processing unit switches between a first display mode and a second display mode, the first display mode changing the expansion coefficient based on the saturation of the input signals, the second display mode keeping the expansion coefficient at a constant value regardless of the saturation of the input signals.

2. The display device according to claim 1, wherein the signal processing unit changes the expansion coefficient based on the saturation and a hue of the input signals.

3. The display device according to claim 1, wherein the signal processing unit stores a plurality of relations between the expansion coefficient and the saturation of the input signals therein and switches therebetween to use.

4. The display device according to claim 1, wherein the signal processing unit decreases the expansion coefficient as the saturation of the input signals increases.

5. The display device according to claim 1, wherein the signal processing unit switches the first display mode and the second display mode therebetween based on a hue of the input signals.

6. The display device according to claim 5, wherein the signal processing unit selects the first display mode when the hue of the input signals is yellow, and selects the second display mode when the hue of the input signals is other than yellow.

7. The display device according to claim 1, wherein, when the output signal is to be output to the fourth sub-pixel, the signal processing unit generates input signals after conversion from the input signals so as to reduce a level of brightness of at east the input signals giving the saturation equal to or higher than a certain level, obtains the output signal for the first sub-pixel based on at least an input signal after conversion of the first sub-pixel and the expansion coefficient and outputs the obtained output signal to the first sub-pixel, obtains the output signal for the second sub-pixel based on at least an input signal after conversion of the second sub-pixel and the expansion coefficient and outputs the obtained output signal to the second sub-pixel, obtains the output signal for the third sub-pixel based on at least an input signal after conversion or the third sub-pixel and the expansion coefficient and outputs the obtained output signal to the third sub-pixel, and obtains the output signal for the fourth sub-pixel based on the input signal after conversion of the first sub-pixel, the input signal after conversion of the second sub-pixel, the input signal after conversion of the third sub-pixel, and the expansion coefficient and outputs the obtained output signal to the fourth sub-pixel.

8. The display device according to claim 7, wherein the input signals after conversion are obtained by conversion using a function that reduces the brightness of the input signals at a constant rate depending on the saturation.

9. The display device according to claim 7, wherein the input signals after conversion are obtained by conversion using a function that reduces the brightness of the input signals to equal to or less than a value obtained by dividing a maximum value of the brightness of the input signals by a maximum value of the brightness in an HSV color space expanded by introducing therein the fourth color.

10. An electronic apparatus comprising:

the display device according to claim 1; and a control device that supplies the input signals to the display device.

* * * * *